US009274496B2

(12) United States Patent
Miyagawa et al.

(10) Patent No.: US 9,274,496 B2
(45) Date of Patent: Mar. 1, 2016

(54) ELECTROPHOTOGRAPHIC PROCESS CARTRIDGE AND ELECTROPHOTOGRAPHIC APPARATUS

(71) Applicant: CANON KABUSHIKI KAISHA, Tokyo (JP)

(72) Inventors: Noboru Miyagawa, Suntou-gun (JP); Satoshi Koide, Otsu (JP); Takehiko Aoyama, Suntou-gun (JP); Daisuke Tanaka, Yokohama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/308,396

(22) Filed: Jun. 18, 2014

(65) Prior Publication Data

US 2014/0295336 A1 Oct. 2, 2014

Related U.S. Application Data

(63) Continuation of application No. PCT/JP2013/005766, filed on Sep. 27, 2013.

(30) Foreign Application Priority Data

Jan. 29, 2013 (JP) ..... 2013-014877

(51) Int. Cl.
*G03G 15/02* (2006.01)
*G03G 21/18* (2006.01)
(Continued)

(52) U.S. Cl.
CPC ..... *G03G 21/1814* (2013.01); *G03G 5/05* (2013.01); *G03G 5/056* (2013.01); *G03G 5/0564* (2013.01);
(Continued)

(58) Field of Classification Search
CPC ..... G03G 15/0233; G03G 5/14752; G03G 5/14756; G03G 5/14786; G03G 5/056; G03G 5/0564; G03G 5/0589; G03G 21/1814
USPC ..... 430/59.6, 66; 399/111, 159
See application file for complete search history.

(56) References Cited

U.S. PATENT DOCUMENTS 4,444,861 A * 4/1984 Nogami et al. ..... 430/58.05
4,716,091 A 12/1987 Yoshihara et al.
(Continued)

FOREIGN PATENT DOCUMENTS

JP 58-167606 A 10/1983
JP 62-75462 A 4/1987
(Continued)

OTHER PUBLICATIONS

English language machine translation of JP 2009-175427 (Aug. 2009).*
(Continued)

*Primary Examiner* — Christopher Rodee
(74) *Attorney, Agent, or Firm* — Fitzpatrick, Cella, Harper and Scinto

(57) ABSTRACT

Uneven charging is improved, and production of a banding image attributed to a slip between the charging member and the electrophotographic photosensitive member is suppressed. An electrophotographic process cartridge including a charging member and an electrophotographic photosensitive member which is electrically charged upon being brought into contact with the charging member, wherein the charging member includes a electro-conductive substrate and a surface layer formed on the electro-conductive substrate; the surface layer contains at least a binder resin, an electron conductive agent, and a resin particle having a plurality of pores inside thereof; the surface of the surface layer has a protrusion derived from the resin particle; the electrophotographic photosensitive member includes a support and a photosensitive layer formed on the support; and the surface layer of the electrophotographic photosensitive member contains a specific component.

8 Claims, 7 Drawing Sheets

(51) Int. Cl.

| | |
|---|---|
| ***G03G 5/05*** | (2006.01) |
| ***G03G 5/147*** | (2006.01) |
| ***G03G 15/00*** | (2006.01) |

(52) U.S. Cl.

CPC ..... *G03G 5/0589* (2013.01); *G03G 5/147* (2013.01); *G03G 5/14752* (2013.01); *G03G 5/14756* (2013.01); *G03G 5/14786* (2013.01); *G03G 15/02* (2013.01); *G03G 15/0233* (2013.01); *G03G 15/75* (2013.01); *G03G 21/18* (2013.01)

(56) References Cited

U.S. PATENT DOCUMENTS

| | | | |
|---|---|---|---|
| 5,437,952 | A | 8/1995 | Hirai et al. |
| 6,899,983 | B2 | 5/2005 | Tamoto et al. |
| 2013/0029256 | A1 | 1/2013 | Tanaka et al. |
| 2014/0205940 | A1 | 7/2014 | Tanaka et al. |
| 2014/0205941 | A1 | 7/2014 | Nishi et al. |

FOREIGN PATENT DOCUMENTS

| | | | | |
|---|---|---|---|---|
| JP | 5-35086 | A | 2/1993 | |
| JP | 5-249763 | A | 9/1993 | |
| JP | 7-261440 | A | 10/1995 | |
| JP | 3278016 | B2 | 4/2002 | |
| JP | 2002-128883 | A | 5/2002 | |
| JP | 2002128883 | A * | 5/2002 | ..... C08G 63/695 |
| JP | 2003-295490 | A | 10/2003 | |
| JP | 2007-47655 | A | 2/2007 | |
| JP | 2007-72277 | A | 3/2007 | |
| JP | 2007-79555 | A | 3/2007 | |
| JP | 2007-199688 | A | 8/2007 | |
| JP | 2009-175427 | A | 8/2009 | |
| JP | 2011-22411 | A | 2/2011 | |
| JP | 2013-50700 | A | 3/2013 | |

OTHER PUBLICATIONS

English language machine translation of JP 2002-128883 (May 2002).*

Diamond, Arthur S & David Weiss (eds.) Handbook of Imaging Materials, 2nd ed.. New York: Marcel-Dekker, Inc. (Nov. 2001) pp. 145-164.*

PCT International Search Report and Written Opinion of the International Searching Authority, International Application No. PCT/JP2013/005766, Mailing Date Dec. 3, 2013.

U.S. Appl. No. 14/338,107, filed Jul. 22, 2014. Inventor: Sato, et al.

U.S. Appl. No. 14/284,945, filed May 22, 2014. Inventor: Matsuda, et al.

International Preliminary Report on Patentability, International Application No. PCT/JP2013/005766 Mailing Date Aug. 13, 2015.

* cited by examiner

ELECTROPHOTOGRAPHIC PROCESS CARTRIDGE AND ELECTROPHOTOGRAPHIC APPARATUS

CROSS-REFERENCE TO RELATED APPLICATIONS

This application is a continuation of International Application No. PCT/JP2013/005766, filed Sep. 27, 2013, which claims the benefit of Japanese Patent Application No. 2013-014877, filed Jan. 29, 2013.

BACKGROUND OF THE INVENTION

1. Field of the Invention

The present invention relates to an electrophotographic process cartridge and an electrophotographic image forming apparatus (hereinafter referred to as an "electrophotographic apparatus").

2. Description of the Related Art

A method for charging the surface of an electrophotographic photosensitive member includes a contact charging method using a charging member in contact with the surface of the electrophotographic photosensitive member. It is said that the contact charging method easily produces uneven charging of the surface of the electrophotographic photosensitive member due to a narrow discharge region between the charging member and the electrophotographic photosensitive member. To such a problem, a charging member containing a roughness forming particle in the surface layer to roughen the surface of the charging member was proposed (Japanese Patent Application Laid-Open No. 2009-175427).

Meanwhile, a toner not transferred onto a transfer material such as paper in a transferring step may adhere to the surface of the electrophotographic photosensitive member mounted on the electrophotographic apparatus. Hereinafter, such a toner is also referred to as the remaining toner. To remove the remaining toner from the surface of the electrophotographic photosensitive member and provide the electrophotographic photosensitive member for the next electrophotographic image forming process, a cleaning member or the like is in contact with the surface of the electrophotographic photosensitive member. For this reason, moderate lubrication and slip properties are demanded of the surface of the electrophotographic photosensitive member. To such a problem, a silicone oil such as polydimethylsiloxane contained in the surface layer of the electrophotographic photosensitive member was proposed (Japanese Patent No. 3278016).

SUMMARY OF THE INVENTION

According to the research by the present inventors, when an electrophotographic photosensitive member having enhanced lubrication in the surface is electrically contact-charged contact charged using a charging member having a roughened surface, the contact area in the nip between the electrophotographic photosensitive member and the charging member decreases, sometimes causing a slight slip when the electrophotographic photosensitive member rotates in contact with the charging member. Such a slip causes uneven charging of the electrophotographic photosensitive member, leading to horizontal streaks produced in an electrophotographic image. Hereinafter, an electrophotographic image having horizontal streaks may be referred to as a "banding image".

Then, the present invention is directed to providing an electrophotographic process cartridge that can attain improvement in uneven charging as the problem of the contact charging method and suppression of production of a banding image attributed to a slip between a charging member and an electrophotographic photosensitive member.

The present invention is directed to providing an electrophotographic apparatus that can form a high-quality electrophotographic image.

According to one aspect of the present invention, there is provided an electrophotographic process cartridge including a charging member and an electrophotographic photosensitive member which is electrically charged upon being brought into contact with the charging member, wherein the charging member includes an electro-conductive substrate and a surface layer formed on the electro-conductive substrate; the surface layer contains at least a binder resin, an electron conductive agent, and a resin particle having a plurality of pores inside thereof; the surface of the surface layer has a protrusion derived from the resin particle; the electrophotographic photosensitive member includes a support and a photosensitive layer formed on the support; and the surface layer of the electrophotographic photosensitive member contains a resin (1), a resin (2), and a compound (3):

resin (1): at least one resin selected from the group consisting of polycarbonate resins having no siloxane structure at a terminal and polyester resins having no siloxane structure at a terminal;

resin (2): at least one resin selected from the group consisting of polycarbonate resins having a siloxane structure at a terminal, polyester resins having a siloxane structure at a terminal, and acrylic resins having a siloxane structure at a terminal;

compound (3): at least one compound selected from the group consisting of methyl benzoate, ethyl benzoate, benzyl acetate, ethyl 3-ethoxypropionate, and diethylene glycol ethyl methyl ether.

According to another aspect of the present invention, there is provided an electrophotographic apparatus on which the electrophotographic process cartridge is mounted.

The present invention can suppress uneven charging attributed to a narrow discharge region, which is the problem in the contact charging method, by using a charging member having a roughened surface. Moreover, the present invention can suppress a slip between the charging member and the electrophotographic photosensitive member and as a result suppress production of a banding image attributed to the slip effectively even when the charging member having a roughened surface is charged in contact with an electrophotographic photosensitive member having enhanced lubrication of the surface.

Further features of the present invention will become apparent from the following description of exemplary embodiments with reference to the attached drawings

DESCRIPTION OF THE EMBODIMENTS

Figure 1A:
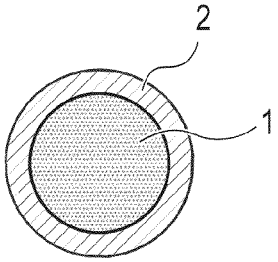
FIG. 1A is a sectional view of a charging roller according to the present invention including a surface layer formed on an electro-conductive substrate.

Preferred embodiments of the present invention will now be described in detail in accordance with the accompanying drawings.

<Mechanism to Suppress Banding Image>

The electrophotographic process cartridge according to the present invention includes a charging member and an electrophotographic photosensitive member which is electrically charged upon being brought into contact with the charging member.

The charging member includes an electro-conductive substrate and a surface layer formed on the electro-conductive substrate. The surface layer contains at least a binder resin, an electron conductive agent, and a resin particle having a plurality of pores inside thereof. The surface of the surface layer has a protrusion derived from the resin particle.

The electrophotographic photosensitive member includes a support and a photosensitive layer formed on the support, and the surface layer of the electrophotographic photosensitive member contains a resin (1), a resin (2), and a compound (3).

resin (1): at least one resin selected from the group consisting of polycarbonate resins having no siloxane structure at a terminal, and polyester resins having no siloxane structure at a terminal;

resin (2): at least one resin selected from the group consisting of polycarbonate resins having a siloxane structure at a terminal, polyester resins having a siloxane structure at a terminal, and acrylic resins having a siloxane structure at a terminal; and compound (3): at least one compound selected from the group consisting of methyl benzoate, ethyl benzoate, benzyl acetate, ethyl 3-ethoxypropionate, and diethylene glycol ethyl methyl ether.

The present inventors presume the mechanism how the electrophotographic process cartridge formed of the charging member and the electrophotographic photosensitive member in combination can suppress production of the banding image as follows.

The compound (3) existing in the surface layer of the electrophotographic photosensitive member according to the present invention has a polarity. For this reason, when DC voltage is applied to the charging member in formation of an electrophotographic image, the compound (3) polarizes in the surface layer, and an electrically attractive force acts between the electrophotographic photosensitive member and protrusions of the charging member contacting the electrophotographic photosensitive member. As a result, the electrophotographic photosensitive member is pressed against the protrusions in the surface of the charging member. At this time, the resin particle, from which the protrusion in the surface of the surface layer formed in the charging member is derived, has a plurality of pores inside thereof. For this reason, the protrusions distort due to the contact pressure of the electrophotographic photosensitive member, increasing the contact area between the electrophotographic photosensitive member and the charging member. As a result, production of a slight slip in the nip between the electrophotographic photosensitive member and the charging member is suppressed, resulting in suppression of the banding image.

<Electrophotographic Photosensitive Member>

The electrophotographic photosensitive member according to the present invention includes a support and a photosensitive layer formed on the support. Examples of the photosensitive layer include a single layer type photosensitive layer in which a charge transport substance and a charge generating substance are contained in the same layer, and a lamination type (separate function type) photosensitive layer in which a charge-generating layer containing a charge generating substance is separated from a charge-transport layer containing a charge transport substance. In the present invention, the lamination type photosensitive layer is preferable. Alternatively, the charge-generating layer may have a lamination structure, or the charge-transport layer may have a lamination configuration. Moreover, to improve the durability of the electrophotographic photosensitive member, a protective layer may be formed on the photosensitive layer.

[Surface Layer]

In the electrophotographic photosensitive member according to the present invention, the surface layer contains a resin (1), a resin (2), and a compound (3). Here, when the charge-transport layer is the surface layer of the electrophotographic photosensitive member, the charge-transport layer is the surface layer. When a protective layer is provided on the charge-transport layer, the protective layer is the surface layer.

The resin (1) is at least one resin selected from the group consisting of polycarbonate resins having no siloxane structure at a terminal, and polyester resins having no siloxane structure at a terminal. The resin (2) is at least one resin selected from the group consisting of polycarbonate resins having a siloxane structure at a terminal, polyester resins having a siloxane structure at a terminal, and acrylic resins having a siloxane structure at a terminal. The compound (3) is at least one compound selected from the group consisting of methyl benzoate, ethyl benzoate, benzyl acetate, ethyl 3-ethoxypropionate, and diethylene glycol ethyl methyl ether.

[Resin (1)]

In the resin (1), the polycarbonate resin having no siloxane structure at a terminal can be a polycarbonate resin A having a structural unit represented by the following formula (A). The polyester resin having no siloxane structure at a terminal can be a polyester resin B having a structural unit represented by the following formula (B).

(A)

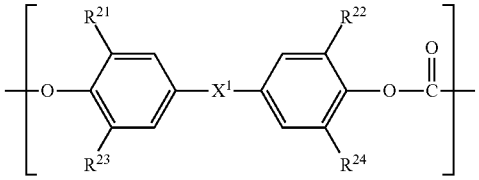

In the formula (A), $R^{21}$ to $R^{24}$ each independently represent a hydrogen atom or a methyl group; $X^1$ represents a single bond, a cyclohexylidene group, or a divalent group having a structural unit represented by the following formula (C).

(B)

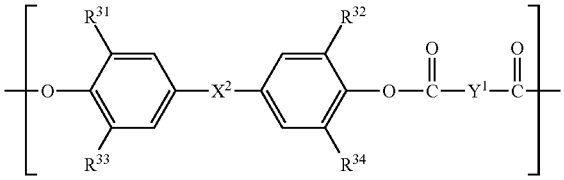

In the formula (B), $R^{31}$ to $R^{34}$ each independently represent a hydrogen atom or a methyl group; $X^2$ represents a single bond, a cyclohexylidene group, or a divalent group having a structural unit represented by the following formula (C); and $Y^1$ represents a m-phenylene group, a p-phenylene group, or a divalent group in which two p-phenylene groups are bonded via an oxygen atom.

(C)

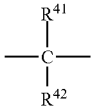

In the formula (C), $R^{41}$ and $R^{42}$ each independently represent a hydrogen atom, a methyl group, or a phenyl group.

Specific examples of the structural unit represented by the formula (A) included in the polycarbonate resin A are shown below:

(A-1)

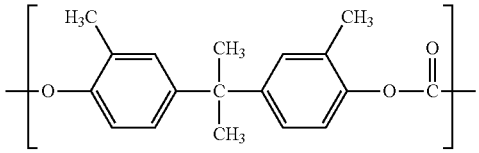

(A-2)

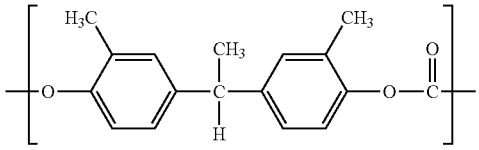

(A-3)

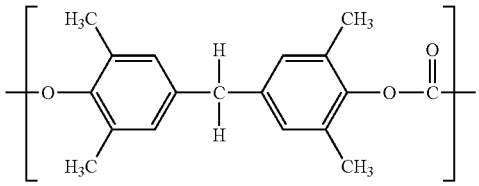

(A-4)

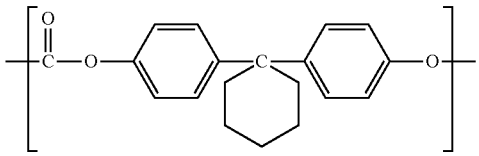

(A-5)

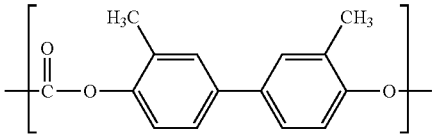

(A-6)

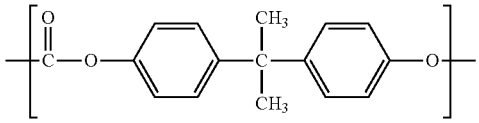

(A-7)

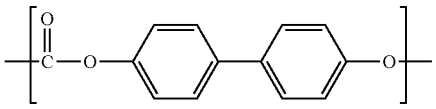

(A-8)

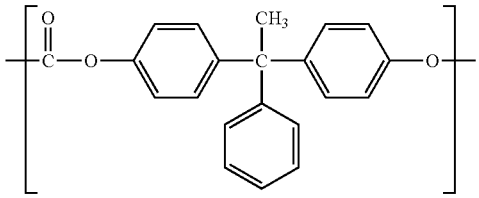

The polycarbonate resin A can be a polymer having only one kind of structural unit selected from the structural units represented by the above formulas (A-1) to (A-8), or a copolymer having two or more kinds of structural units above. Among these structural units, structural units represented by the formulas (A-1), (A-2), and (A-4) are preferable.

Specific examples of the structural unit represented by the formula (B) included in the polyester resin B are shown below:

(B-1)

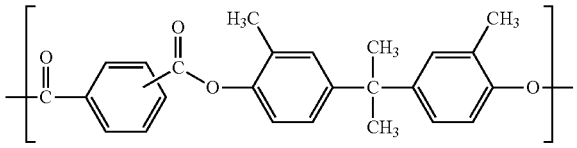

(B-2)

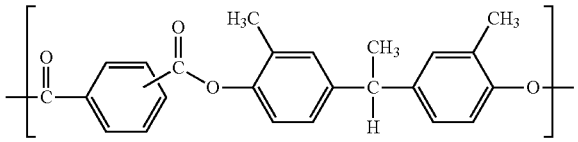

(B-3)

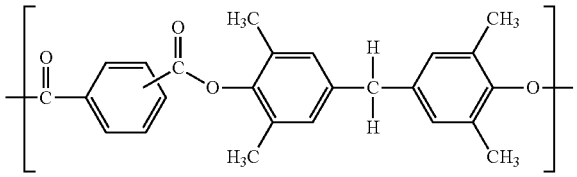

(B-4)

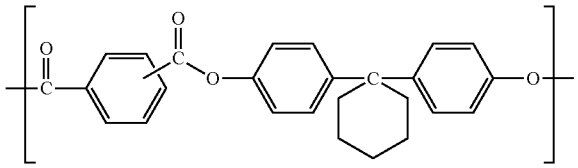

(B-5)

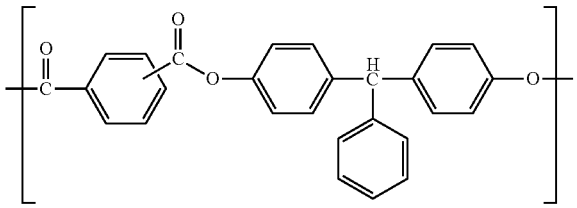

(B-6)

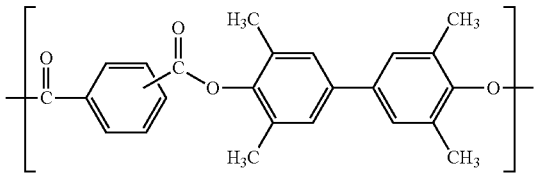

(B-7)

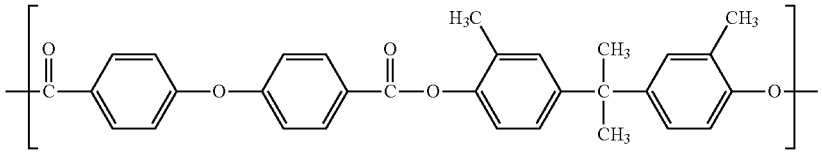

(B-8)

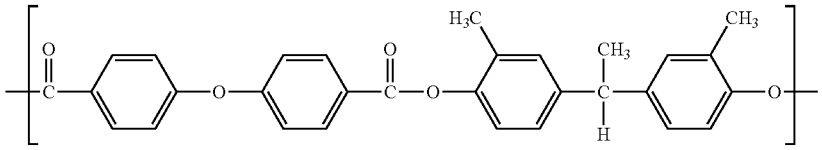

(B-9)

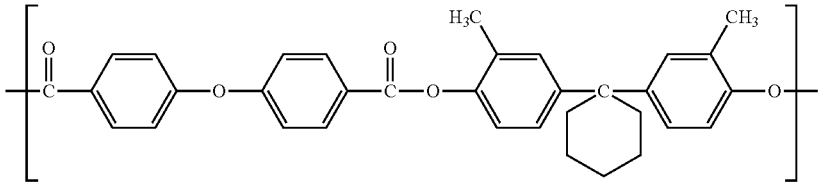

The polyester resin B can be a polymer having only one kind of structural unit selected from the structural units represented by the above formulas (B-1) to (B-9), or a copolymer having two or more kinds of structural units above. Among these structural units, structural units represented by the formulas (B-1), (B-2), (B-3), (B-6), (B-7), and (B-8) are preferable.

The polycarbonate resin A and the polyester resin B can be synthesized by a known phosgene method, for example. Alternatively, these resins can be synthesized by transesterification.

When the above polycarbonate resin A or polyester resin B is a copolymer, the form of copolymerization may be any of block copolymerization, random copolymerization, and alternating copolymerization. These polycarbonate resin A and polyester resin B can be synthesized by a known method. For example, these can be synthesized by methods described in Japanese Patent Application Laid-Open Nos. 2007-047655 and 2007-072277.

The mass average molecular weight of the polycarbonate resin A and that of the polyester resin B are preferably 20,000 or more and 300,000 or less, and more preferably 50,000 or more and 200,000 or less. The mass average molecular weight of the resin means a mass average molecular weight in terms of polystyrene according to the standard method in which the measurement is performed by the method described in Japanese Patent Application Laid-Open No. 2007-079555.

The polycarbonate resin A or polyester resin B as the resin (1) may be a copolymer having a structural unit including a siloxane structure in the main chain in addition to the structural unit represented by the above formula (A) or the formula (B). Specifically, examples of such a structural unit include structural units represented by the following formula (H-1) or (H-2). Furthermore, these resins may have a structural unit represented by the following formula (H-3).

(H-1)

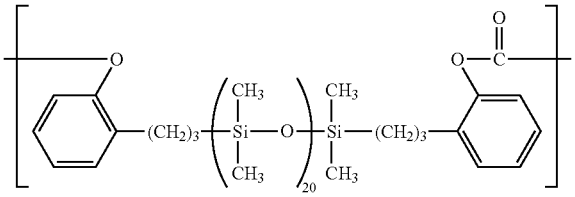

(H-2)

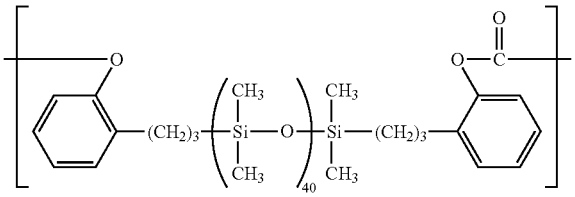

(H-3)

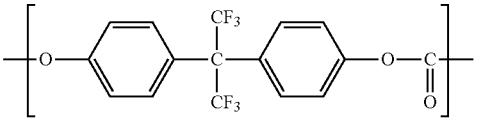

Specific resins used as the resin (1) will be shown below.

TABLE 1

| Resin (1) (polycarbonate resin A or polyester resin B) | Structural unit | Structural unit (mass ratio) | Weight average molecular weight (Mw) |
|---|---|---|---|
| Resin A (1) | (A-4) | — | 55,000 |
| Resin A (2) | (A-4) | — | 14,000 |
| Resin A (3) | (A-4) | — | 110,000 |
| Resin A (4) | (A-6) | — | 55,000 |
| Resin A (5) | (A-1) | — | 54,000 |
| Resin A (6) | (A-6)/(A-1) | 6.5/3.5 | 55,000 |
| Resin A (7) | (A-4)/(H-1) | 9/1 | 55,000 |
| Resin A (8) | (A-4)/(H-1) | 9/1 | 110,000 |
| Resin A (9) | (A-4)/(H-1)/(H-3) | 6/1.5/2.5 | 60,000 |
| Resin B (1) | (B-1) | — | 120,000 |
| Resin B (2) | (B-1)/(B-6) | 7/3 | 120,000 |
| Resin B (3) | (B-8) | — | 100,000 |

In Table 1, in the structural units represented by the formulas (B-1) and (B-6) in Resin B(1) and Resin B(2), the molar ratio of a terephthalic acid structure to an isophthalic acid structure (terephthalic acid skeleton/isophthalic acid skeleton) is 5/5.

[Resin (2)]

The resin (2) is at least one resin selected from the group consisting of polycarbonate resins having a siloxane structure at a terminal, polyester resins having a siloxane structure at a terminal, and acrylic resins having a siloxane structure at a terminal. These resins (2) has high miscibility with the resin (1), keeping the mechanical durability of the surface layer in the electrophotographic photosensitive member high. Since the resin (2) has a siloxane moiety at the terminal, the surface layer can attain high lubrication, and the initial friction coefficient of the surface layer can be reduced. It is supposedly because that when the resin (2) has a dimethylpolysiloxane (siloxane) moiety at the terminal, the siloxane portion has increased freedom to raise the probability that the resin (2) migrates to the surface portion of the surface layer; as a result, the resin (2) is likely to exist in the surface of the electrophotographic photosensitive member.

In the present invention, the polycarbonate resin having a siloxane structure at a terminal can be a polycarbonate resin A' having a structural unit represented by the following formula (A') and a terminal structure represented by the following formula (D). Moreover, the polyester resin having a siloxane structure at a terminal can be a polyester resin B' having a structural unit represented by the following formula (B') and a terminal structure represented by the following formula (D).

(A')

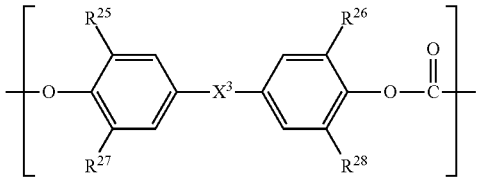

In the formula (A'), $R^{25}$ to $R^{28}$ each independently represent a hydrogen atom or a methyl group; $X^3$ represents a single bond, a cyclohexylidene group, or a divalent group having a structural unit represented by the following formula (C').

(B')

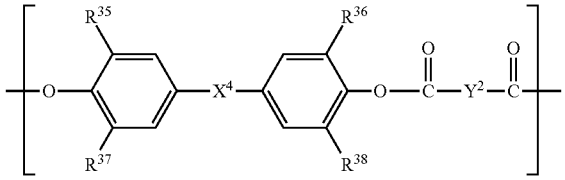

In the formula (B'), $R^{35}$ to $R^{38}$ each independently represent a hydrogen atom or a methyl group; $X^4$ represents a single bond, a cyclohexylidene group, or a divalent group having a structural unit represented by the following formula (C'); $Y^2$ represents a m-phenylene group, a p-phenylene group, or a divalent group in which two p-phenylene groups are bonded via an oxygen atom.

(C')

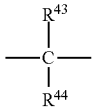

In the formula (C'), $R^{43}$ and $R^{44}$ each independently represent a hydrogen atom, a methyl group, or a phenyl group.

(D)

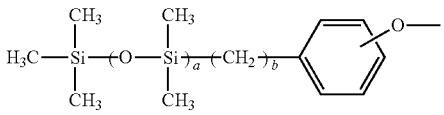

In the formula (D), a and b represent the repetition number of the structural unit within the brackets, the average value of a is 20 or more and 100 or less, and the average value of b is 1 or more and 10 or less. More preferably, the average value of a is 30 or more and 60 or less, and the average value of b is 3 or more and 10 or less.

In the present invention, the polycarbonate resin A' and the polyester resin B' have a terminal structure represented by the above formula (D) at one terminal or both terminals of the resin. When the resin has the terminal structure represented by the above formula (D) at one terminal thereof, a molecular weight adjusting agent (terminal agent) is used. Examples of the molecular weight adjusting agent include phenol, p-cumylphenol, p-tert-butylphenol, or benzoic acid. In the present invention, phenol or p-tert-butylphenol is preferable.

When the resin has the terminal structure represented by the above formula (D) at one terminal, the structure of the other terminal (other terminal structure) is a structure illustrated below:

(G-1)

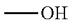

(G-2)

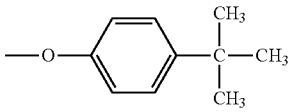

Specific examples of the terminal siloxane structure represented by the formula (D) will be shown below:

(D-1)

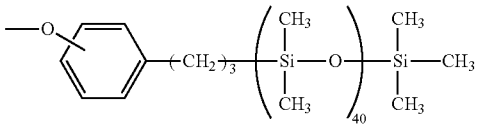

(D-2)

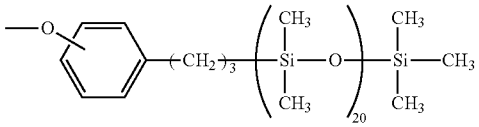

(D-3)

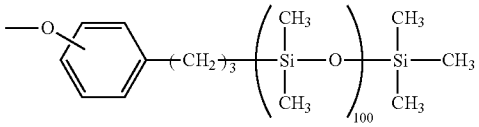

(D-4)

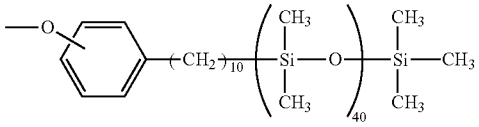

(D-5)

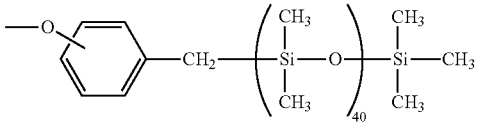

In the polycarbonate resin A', specific examples of the structural unit represented by the formula (A') include structural units represented by the above formulas (A-1) to (A-8). The polycarbonate resin A' can be a polymer having only one kind of structural unit selected from the structural units represented by the above formulas (A-1) to (A-8), or a copolymer having two or more kinds of structural units above. Among these structural units, structural units represented by the formulas (A-1), (A-2), and (A-4) are preferable, and particularly the structural unit represented by the formula (A-4) is preferable.

In the polyester resin B', specific examples of the structural unit represented by the formula (B') include structural units represented by the above formulas (B-1) to (B-9). The polyester resin B' can be a polymer having only one kind of structural unit selected from the structural units represented by the above formulas (B-1) to (B-9), or a copolymer having two or more kinds of structural units above. Among these structural units, structural units represented by the formulas (B-1), (B-2), (B-3), (B-6), (B-7), and (B-8) are preferable, and further the structural units represented by the formulas (B-1) and (B-3) are particularly preferable.

When the polycarbonate resin A' or polyester resin B' is a copolymer, the form of copolymerization may be any of block copolymerization, random copolymerization, and alternating copolymerization. The polycarbonate resin A' or the polyester resin B' may have a structural unit having a siloxane structure in the main chain. Examples of the resin include copolymers having a structural unit represented by the following formula (H).

(H)

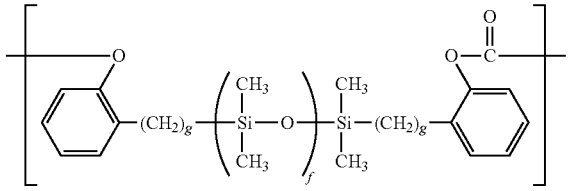

In the formula (H), f and g represent the repetition number of the structural unit within the brackets, the average value of f is 20 or more and 100 or less, and the average value of g is 1 or more and 10 or less. Specific examples of the structural unit represented by the formula (H) include structural units represented by the above formula (H-1) or (H-2).

In the present invention, the "siloxane moiety" in the polycarbonate resin A' or polyester resin B' refers to a portion surrounded by the dotted lines in the terminal structure represented by the following formula (D-S). Furthermore, when the polycarbonate resin A' or polyester resin B' has the structural unit represented by the formula (H), the siloxane moiety includes the structure surrounded by the dotted lines in the structural unit represented by the following formula (H-S).

(D-S)

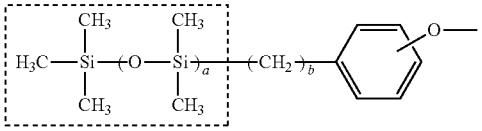

(H-S)

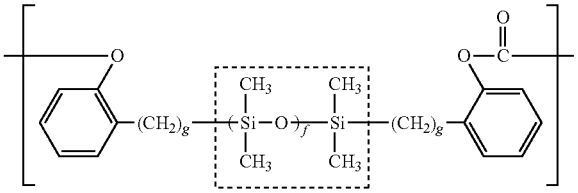

In the present invention, the polycarbonate resin A' and the polyester resin B' can be synthesized by a known method such as the method described in Japanese Patent Application Laid-Open No. 2007-199688. In the present invention, using the same synthesis method and raw materials according to the polycarbonate resin A' and the polyester resin B', the polycarbonate resin A' and polyester resin B' shown in Synthesis Examples in Table 2 can be synthesized. The composition of the polycarbonate resin A' and that of the polyester resin B' can be identified as follows: after the resin is fractionated and separated using size exclusion chromatography, the fractionated components are measured by $^{1}$H-NMR, and the relative ratio of the above siloxane moiety in the resin is determined. In the synthesized polycarbonate resin A' and polyester resin B', the mass average molecular weight and the content of the siloxane moiety are shown in Table 2.

Specific examples of the polycarbonate resin A' and the polyester resin B' are shown below.

TABLE 2

| Resin (2) (polycarbonate resin A' or polyester resin B') | Structural unit in main chain | Terminal siloxane structure | Another terminal structure | Content of siloxane moiety (% by mass) | Weight average molecular weight (Mw) |
|---|---|---|---|---|---|
| Resin A' (1) | (A-4) | (D-1) | — | 23% | 50,000 |
| Resin A' (2) | (A-2) | (D-5) | — | 25% | 48,000 |
| Resin A' (3) | (A-4) and (H-2) | (D-1) | — | 32% | 54,000 |
| Resin A' (4) | (A-4) | (D-1) | (G-2) | 12% | 49,000 |
| Resin B' (1) | (B-1) | (D-1) | — | 22% | 42,000 |

In Table 2, in the resin A'(3), the mass ratio (A-4):(H-2) of the structural units in the main chain is 9:1.

In the present invention, the acrylic resin having a siloxane structure at a terminal can be an acrylic resin F having at least one structural unit selected from the group consisting of structural units represented by the following formulas (F-1), (F-2), and (F-3).

(F-1)

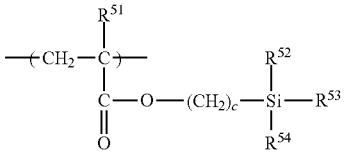

In the formula (F-1), $R^{51}$ represents hydrogen or a methyl group; c represents the repetition number of the structural unit within the brackets, and the average value of c is 0 or more and 5 or less; $R^{52}$ to $R^{54}$ each independently represent a structure represented by the following formula (F-1-2), a methyl group, a methoxy group, or a phenyl group; at least one of $R^{52}$ to $R^{54}$ have a structure represented by the following formula (F-1-2):

(F-1-2)

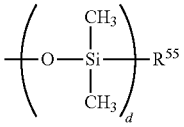

In the formula (F-1-2), d represents the repetition number of the structural unit within the brackets, the average value of d is 10 or more and 50 or less; $R^{55}$ represents a hydroxyl group or a methyl group.

(F-2)

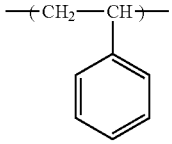

(F-3)

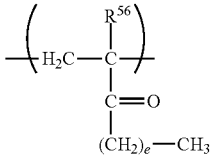

In the formula (F-3), $R^{56}$ represents hydrogen, a methyl group, or a phenyl group; e represents 0 or 1.

In the present invention, the "siloxane moiety" in the acrylic resin F refers to a portion surrounded by the dotted lines in the structure represented by the following formula (F-S) or (F-T):

(F-S)

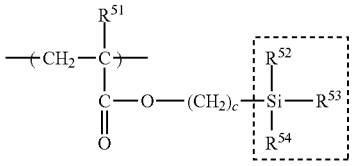

(F-T)

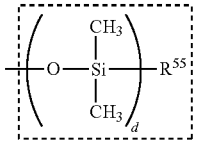

Specific examples of the structural unit in the acrylic resin F will be shown in Tables 3-1 to 3-4 below. "Mass ratio in structural unit" in Tables 3-1 to 3-4 is "(F-1)/(F-2) or (F-3)". In Tables 3-3 and 3-4, "Ar" represents an aryl group.

TABLE 3-1

| Compound Example | (F-1) | (F-2) or (F-3) | Mass ratio of structural units | Weight average molecular weight (Mw) |
|---|---|---|---|---|
| F-A | 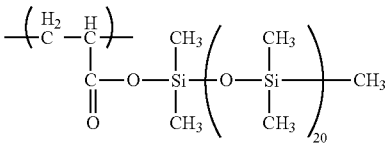 | 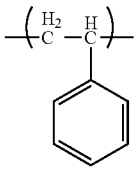 | 2/8 | 105,000 |

TABLE 3-1-continued

| Compound Example | (F-1) | (F-2) or (F-3) | Mass ratio of structural units | Weight average molecular weight (Mw) |
|---|---|---|---|---|
| F-B | 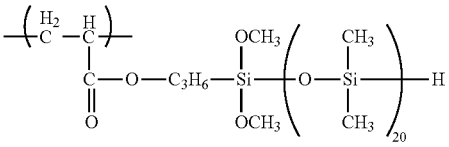 | 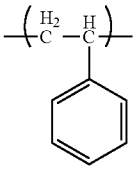 | 2/8 | 100,000 |

TABLE 3-2

| Compound Example | (F-1) | (F-2) or (F-3) | Mass ratio of structural units | Weight average molecular weight (Mw) |
|---|---|---|---|---|
| F-C | 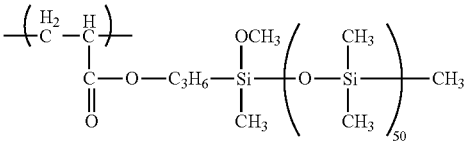 | 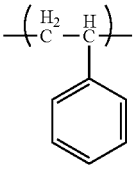 | 1/9 | 100,000 |
| F-D | 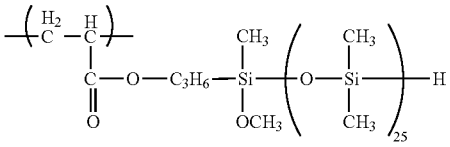 | 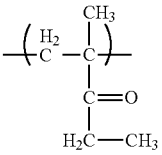 | 1/9 | 105,000 |

TABLE 3-3

| Compound Example | (F-1) | (F-2) or (F-3) | Mass ratio of structural units | Weight average molecular weight (Mw) |
|---|---|---|---|---|
| F-E | 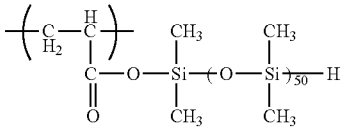 | 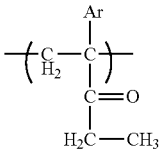 | 2/8 | 110,000 |

TABLE 3-4

| Compound Example | (F-1) | (F-2) or (F-3) | Mass ratio of structural units | Weight average molecular weight (Mw) |
|---|---|---|---|---|
| F-F | 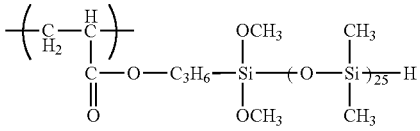 | 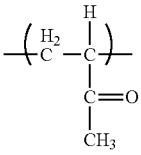 | 1.5/8.5 | 100,000 |

TABLE 3-4-continued

| Compound Example | (F-1) | (F-2) or (F-3) | Mass ratio of structural units | Weight average molecular weight (Mw) |
|---|---|---|---|---|
| F-G | 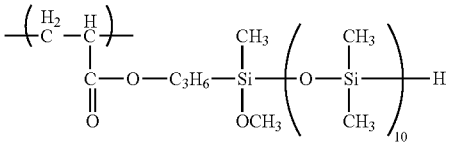 | 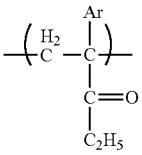 | 1/9 | 110,000 |

Among specific examples of the acrylic resin F shown in Tables 3-1 to 3-4 above, resins represented by Compound Examples (F-B) and (F-E) are preferable.

These acrylic resins can be synthesized by a known method such as the methods described in Japanese Patent Application Laid-Open Nos. S58-167606 and S62-075462.

From the viewpoint of reduction in the initial friction coefficient of the surface layer and suppression in fluctuation of the bright potential in repeated use, the content of the resin (2) in the surface layer in the electrophotographic photosensitive member is preferably 0.1% by mass or more and 50% by mass or less based on the total mass of the resin (1). The content is more preferably 1% by mass or more and 50% by mass or less. At a content of the resin (2) within the above range, the compound (3) in the surface layer has increased freedom to easily polarize. For this reason, an effect of improving the grip properties to the charging member is exhibited.

[Compound (3)]

The surface layer in the electrophotographic photosensitive member according to the present invention contains at least one compound selected from the group consisting of methyl benzoate, ethyl benzoate, benzyl acetate, ethyl 3-ethoxypropionate, and diethylene glycol ethyl methyl ether as the compound (3).

Since the surface layer contains these compounds, the electrophotographic photosensitive member attains effects of stability of the potential in repeated use of the electrophotographic photosensitive member and suppression in a slip between the charging member and the electrophotographic photosensitive member, and at the same time the compound (3) polarizes on the surface layer in formation of an image, attaining an effect of improving grip properties to the charging member. For this reason, the amount of the compound (3) to be added can be 0.001% by mass or more and 0.5% by mass or less based on the total mass of the surface layer. The compound (3) easily volatizes during the heat drying step in formation of the surface layer. For this reason, the content (% by mass) of the compound (3) in the coating solution for a surface layer can be larger than the content (% by mass) of the compound (3) in the surface layer. Accordingly, the content of the compound (3) in the coating solution for a surface layer can be 5% by mass or more and 80% by mass or less based on the total mass of the coating solution for a surface layer.

The content of the compound (3) in the surface layer can be determined by the measurement method described below, for example.

The measurement is performed using an HP7694 Headspace samper (made by Agilent Technologies, Inc.) and an HP6890 series GS System (made by Agilent Technologies, Inc.). A sample piece having a size of 5 mm×40 mm and including the surface layer is cut from the produced electrophotographic photosensitive member. This sample piece is placed into a vial. The Headspace sampler (HP7694 Headspace samper) is set as follows: Oven: 150° C., Loop: 170° C., and Transfer Line: 190° C. The gas that generates from the sample piece is measured by a gas chromatograph (HP6890 series GS System).

The mass of the surface layer in the sample piece is measured as follows. First, the mass of the sample piece used in the above measurement is weighed. Here, the mass of the compound (3) that volatizes from the surface layer in the measurement with the above gas chromatograph is considered to allow to be neglected. Next, the sample piece is immersed in methyl ethyl ketone for 5 minutes to remove the surface layer, and dried at 100° C. for 5 minutes. The mass of the sample piece obtained after removal of the surface layer is weighed. From the difference between these masses, the mass of the surface layer that the sample piece has is determined.

[Support]

The support in the electrophotographic photosensitive member is a support having conductivity (electro-conductive support). Examples of the support include those made of metals such as aluminum, stainless steel, copper, nickel, and zinc or alloys thereof. In the case of the supports made of aluminum or an aluminum alloy, ED tubes, EI tubes, and those subjected to machining, electrochemical mechanical polishing (electrolysis using an electrode having electrolysis action and an electrolyte solution and polishing with a grinding wheel having polishing action), or wet or dry honing can also be used. Examples of the support also include metal supports and resin supports having a thin film formed thereon, the thin film being made of a conductive material such as aluminum, an aluminum alloy, or an indium oxide-tin oxide alloy.

Moreover, supports prepared by impregnating a conductive particle such as carbon black, a tin oxide particle, a titanium oxide particle, and a silver particle with a resin, and plastics containing a conductive binder resin can be used. The surface of the electro-conductive support may be subjected to machining, surface roughening, or an anodized aluminum treatment in order to prevent interference fringes caused by scattering of laser light or the like.

[Electrically Conductive Layer]

In the electrophotographic photosensitive member according to the present invention, an electrically conductive layer containing a conductive particle and a resin may be provided on the support. The electrically conductive layer is a layer formed using a coating solution for an electrically conductive layer prepared by dispersing a conductive particle in a binder resin.

Examples of the conductive particle include carbon black and acetylene black; powders of metals such as aluminum, nickel, iron, nichrome, copper, zinc, and silver; powders of metal oxide such as conductive tin oxide and ITO.

Examples of the binder resin used in the electrically conductive layer include polyester resins, polycarbonate resins, polyvinyl butyral resins, acrylic resins, silicone resins, epoxy resins, melamine resins, urethane resins, phenol resins, and alkyd resins.

Examples of the solvent used in the coating solution for an electrically conductive layer include ether solvents, alcohol solvents, ketone solvents, and aromatic hydrocarbon solvents. The layer thickness of the electrically conductive layer is 0.2 μm or more and 40 μm or less, particularly 1 μm or more and 35 μm or less, and more preferably 5 μm or more and 30 μm or less.

[Intermediate Layer]

An intermediate layer may be provided between the electro-conductive support or electrically conductive layer and the photosensitive layer. The intermediate layer is formed for improvement in the adhesiveness of the photosensitive layer, applicability, and charge injection properties from the electro-conductive support and protection of the photosensitive layer against electrical breakdown.

The intermediate layer can be formed by applying a coating solution for an intermediate layer containing a binder resin onto the electro-conductive support or electrically conductive layer, and drying or curing the coating solution.

Examples of the binder resin used in the intermediate layer include polyacrylic acids, methyl cellulose, ethyl cellulose, polyamide resins, polyimide resins, polyamidimide resins, polyamic acid resins, melamine resins, epoxy resins, and polyurethane resins. The binder resin used in the intermediate layer can be thermoplastic resins, and specifically thermoplastic polyamide resins. The polyamide resins can be low crystalline or non-crystalline copolymerized nylons applicable in a liquid state. Examples of the solvent used in the coating solution for an intermediate layer include ether solvents, alcohol solvents, ketone solvents, and aromatic hydrocarbon solvents. The layer thickness of the intermediate layer is preferably 0.05 μm or more and 40 μm or less, and more preferably 0.1 μm or more and 30 μm or less. The intermediate layer may also contain a semiconductive particle, an electron transport substance, or an electron accepting substance.

[Photosensitive Layer]

A photosensitive layer (charge-generating layer, charge-transport layer) is formed on the electro-conductive support, electrically conductive layer, or intermediate layer. The charge-generating layer can be formed by applying a coating solution for a charge-generating layer prepared by dispersing a charge generating substance with a binder resin and a solvent, and drying the coating solution. The charge-generating layer may also be a deposition film of the charge generating substance.

Examples of the charge generating substance include azo pigments, phthalocyanine pigments, indigo pigments, and perylene pigments. These charge generating substances may be used alone or in combination of two or more. Among these, particularly oxytitanium phthalocyanine, hydroxygallium phthalocyanine, and chlorogallium phthalocyanine are preferable for their high sensitivity.

Examples of the binder resin used in the charge-generating layer include polycarbonate resins, polyester resins, polybutyral resins, polyvinyl acetal resins, acrylic resins, vinyl acetate resins, urea resins, and copolymerized resins prepared by copolymerizing monomers that are raw materials for these resins. Among these, butyral resins are particularly preferable. These resins can be used alone or in combination of two or more.

Examples of the dispersing method include methods using a homogenizer, an ultrasonic, a ball mill, a sand mill, an Attritor, or a roll mill. For the proportion of the charge generating substance to the binder resin, the charge generating substance is in the range of preferably 0.1 parts by mass or more and 10 parts by mass or less, and more preferably 1 part by mass or more and 3 parts by mass or less based on 1 part by mass of the binder resin. Examples of the solvent used in the coating solution for a charge-generating layer include alcohol solvents, sulfoxide solvents, ketone solvents, ether solvents, ester solvents, and aromatic hydrocarbon solvents. The layer thickness of the charge-generating layer is preferably 0.01 μm or more and 5 μm or less, and more preferably 0.1 μm or more and 2 μm or less.

A variety of sensitizers, antioxidants, ultraviolet absorbing agents, and plasticizers may be added to the charge-generating layer when necessary. To prevent a flow of charges (carriers) from stagnating in the charge-generating layer, the charge-generating layer may contain an electron transport substance and an electron accepting substance. In the electrophotographic photosensitive member including a lamination type photosensitive layer, a charge-transport layer is provided on the charge-generating layer. The charge-transport layer can be formed by applying a coating solution for a charge-transport layer prepared by dissolving a charge transport substance and a binder resin in a solvent, and drying the coating solution. Examples of the charge transport substance include triarylamine compounds, hydrazone compounds, styryl compounds, and stilbene compounds. The charge transport substance can be compounds represented by the following structure formulas (CTM-1) to (CTM-7).

(CTM-1)

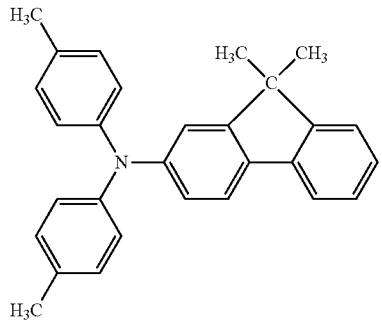

(CTM-2)

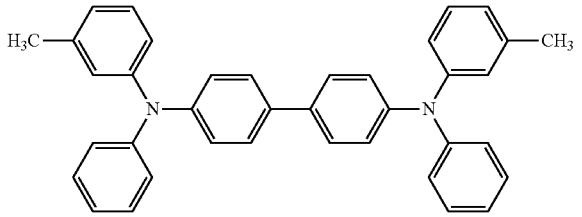

(CTM-3)

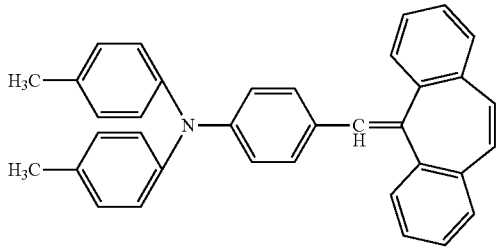

-continued (CTM-4)

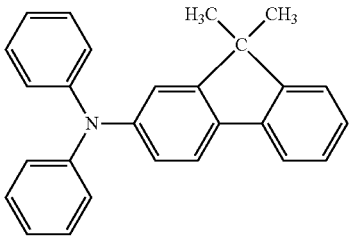

(CTM-5)

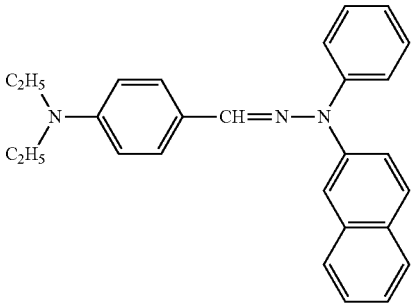

(CTM-6)

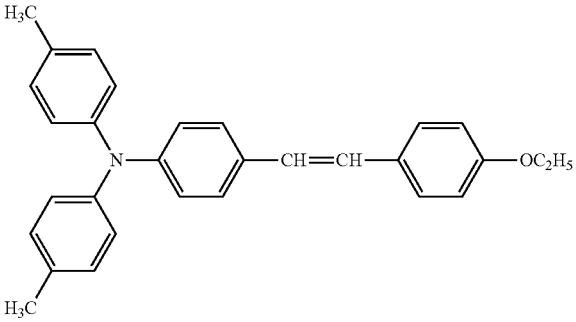

(CTM-7)

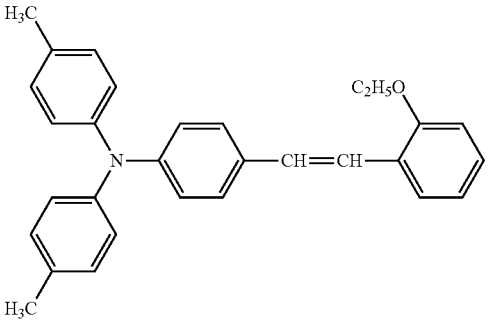

In the present invention, when the charge-transport layer is the surface layer, the binder resin contains the resin (1) and the resin (2). Another resin may be further mixed and used. The other resin that may be mixed and used are as described above. The layer thickness of the charge-transport layer is preferably 5 to 50 μm, and more preferably 10 to 30 μm. The mass ratio of the charge transport substance to the binder resin is preferably 5:1 to 1:5, and more preferably 3:1 to 1:3. Examples of the solvent used in the coating solution for a charge-transport layer include alcohol solvents, sulfoxide solvents, ketone solvents, ether solvents, ester solvents, and aromatic hydrocarbon solvents. The solvent can be xylene, toluene, and tetrahydrofuran.

A variety of additives can be added to the layers in the electrophotographic photosensitive member according to the present invention. Examples of the additives include degradation preventing agents such as an antioxidant, an ultraviolet absorbing agent, and a light stabilizer, organic fine particles, and inorganic fine particles. Examples of the degradation preventing agents include hindered phenol antioxidants, hindered amine light stabilizers, sulfur atom-containing antioxidants, and phosphorus atom-containing antioxidants. Examples of the organic fine particles include high molecule resin particles such as fluorine atom-containing resin particles, polystyrene fine particles, and polyethylene resin particles. Examples of the inorganic fine particles include metal oxides such as silica and alumina. When the above coating solutions for the layers are applied, an application method such as an immersion coating method, a spray coating method, a spinner coating method, a roller coating method, a Meyer bar coating method, or a blade coating method can be used. Among these, the immersion coating method is preferable. The drying temperature when the above coating solutions for the layers are dried to form a coating can be 60° C. or more and 150° C. or less. Among these, the drying temperature of the coating solution for a charge-transport layer (coating solution for a surface layer) is particularly preferably 110° C. or more and 140° C. or less. The drying time is preferably 10 to 60 minutes, and more preferably 20 to 60 minutes.

<Charging Member>

Figure 1B:
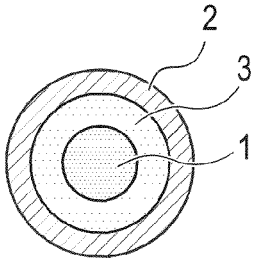
FIG. 1B is a sectional view of a charging roller according to the present invention including an electro-conductive elastic layer formed between the electro-conductive substrate and the surface layer.
Figure 1C:
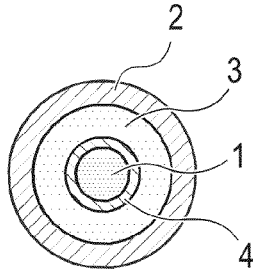
FIG. 1C is a sectional view of a charging roller according to the present invention including an electro-conductive adhesive layer and an electro-conductive elastic layer formed between the electro-conductive substrate and the surface layer.

The charging member according to the present invention can have a roller shape, a flat plate shape, or a belt shape, for example. With reference to roller-like charging members illustrated in FIGS. 1A, 1B, and 1C (hereinafter also referred to as a "charging roller"), charging member according to the present invention will be described below. The charging roller illustrated in FIG. 1A has an electro-conductive substrate 1 and a surface layer 2 formed on the substrate. The charging roller illustrated in FIG. 1B has an electro-conductive elastic layer 3 between the electro-conductive substrate 1 and the surface layer 2. The electro-conductive elastic layer 3 may have a multi-layer structure. The charging roller illustrated in FIG. 1C is an example in which an electro-conductive adhesive layer 4 is provided between the electro-conductive substrate 1 and the electro-conductive elastic layer 3.

[Surface Layer]

The surface layer contains a binder resin, an electron conductive agent, and a resin particle having a plurality of pores inside thereof. The surface of the surface layer has a protrusion derived from the resin particle. Besides the substances above, the surface layer can arbitrarily contain an insulation metal particle, a leveling agent, a plasticizer, and a softening agent. To form a protrusion derived from the resin particle, the layer thickness of the surface layer can be approximately 0.1 μm to 100 μm.

The volume resistivity of the surface layer in an environment of a temperature of 25° C., relative humidity of 50% can be $1\times10^{2}$ Ω·cm or more and $1\times10^{16}$ Ω·cm or less. To properly charge the electrophotographic photosensitive member by discharging, the volume resistivity is more preferably in the range of $1\times10^{5}$ Ω·cm or more and $1\times10^{8}$ Ω·cm or less.

The volume resistivity of the surface layer is determined as follows. First, the surface layer is cut out from the charging member to produce a piece having a length of 5 mm, a width of 5 mm, and a thickness of 1 mm or the like. Next, a metal is deposited onto both surfaces of the piece to obtain a sample for measurement. When the surface layer cannot be cut out in a form of a thin film, a conductive resin composition for forming a surface layer is applied onto an aluminum sheet to form a coating, and a metal is deposited onto the coating surface to obtain a sample for measurement. A voltage of 200 V is applied to the obtained sample for measurement using a microammeter (trade name: ADVANTEST R8340A ULTRA HIGH RESISTANCE METER, made by Advantest Corporation). Then, the current after 30 seconds is measured. The volume resistivity is determined by calculation from the thickness of the film and the area of the electrode. The volume resistivity of the surface layer can be controlled by an electron conductive agent such as a conductive fine particle and an ionic conductive agent.

[Resin Particle Having a Plurality of Pores]

The resin particle from which the protrusion in the surface of the charging member is derived has a plurality of pores inside thereof. The pore designates a region containing air inside thereof. The charging member having a protrusion derived from the resin particle having a plurality of pores can be formed using a "hollow particle" and a "porous particle" described later.

Here, the "porous particle" is defined as a particle having pores penetrating through the surface thereof (hereinafter also referred to as a "through hole" or a "micropore"). The definition of the "porous particle" includes a particle having the through hole and a pore having air inside thereof and not penetrating through the surface of the particle (hereinafter also referred to as a "non-through hole").

In contrast, a "hollow particle" is defined as a particle having only a non-through hole.

The porous particle and the hollow particle can be determined by the following method, for example.

Namely, the resin particle to be determined is embedded using a photocurable resin such as visible light-curable embedding resins (trade name: D-800, made by Nisshin EM Corporation, trade name: Epok812 Set, made by Okenshoji Co., Ltd.). At this time, when the resin particle to be determined is the porous particle, the embedding resin invades the through holes inside of the resin particle. When the resin particle to be determined is the hollow particle, the embedding resin particle cannot invade into the non-through hole inside of the resin particle.

Next, after trimming is performed using an ultramicrotome (trade name: LEICA EM UCT, made by Leica) on which a diamond knife (trade name: DiATOMECRYO DRY, made by Diatome AG) is mounted, and a cryosystem (trade name: LEICA EM FCS, made by Leica), the center of the resin particle (to include a portion in the vicinity of the center of gravity 17 illustrated in FIG. 8) is cut out to form a section having a thickness of 100 nm. Subsequently, the embedding resin is dyed with any one of dyeing agent selected from osmium tetraoxide, ruthenium tetraoxide, and phosphorus tungstate. Next, a sectional image of the resin particle in the section is photographed with a transmission electron microscope (trade name: H-7100FA, made by Hitachi, Ltd.). Thereby, the through holes into which the embedding resin invades are observed as black portions. In contrast, the non-through holes into which the embedding resin cannot invade are observed as white portions brighter than the resin portion.

Accordingly, when the pores into which the embedding resin invades are observed as black portions, the resin particle to be determined is found to be the porous particle. When no black portions are observed and the bright white portions indicating the pores not embedded using the embedding resin are observed, the resin particle to be determined is found to be the hollow particle. Hereinafter, the method may be referred to as an "embedding method".

Figure 2A:
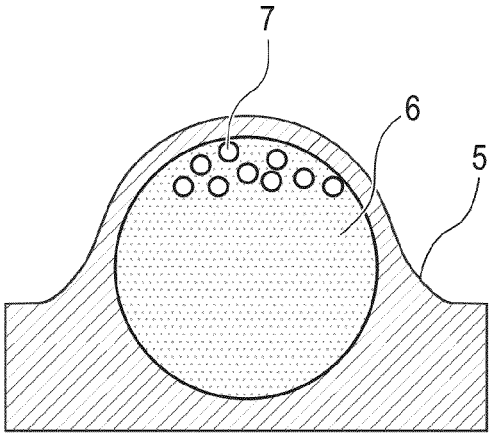
FIG. 2A is a sectional view of a porous particle dispersed in the surface layer formed in the charging roller according to the present invention, which illustrates the state where pores exist in an upper portion of a protrusion.
Figure 2B:
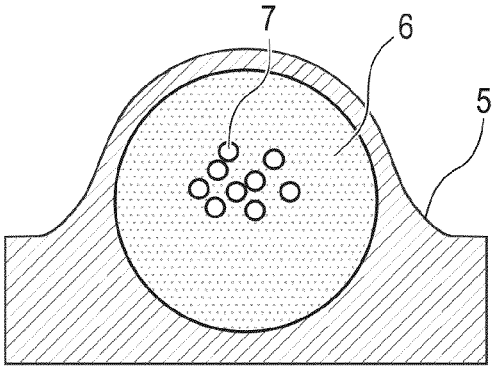
FIG. 2B is a sectional view of a porous particle dispersed in the surface layer formed in the charging roller according to the present invention, which illustrates the state where pores exist inside of a protrusion.

FIGS. 2A and 2B each illustrate a cross section in the vicinity of the protrusion derived from the porous particle in the surface layer formed using the porous particle.

FIG. 2A is a sectional view of the surface layer formed using the porous particle according to a first aspect of the present invention, illustrating the state where pores 7 inside of a resin particle 6 concentrate on a "vertex side region of protrusion" in the resin particle 6. The reference sign 5 designates a resin composition (conductive resin composition) in the surface layer is illustrated.

FIG. 2B is a sectional view of the surface layer formed using the porous particle according to a second aspect of the present invention, illustrating the state where the pores 7 inside of the resin particle 6 concentrate on the inner layer portion of the resin particle 6.

In the resin particle in the surface layer, the porosity in the "vertex side region of protrusion" can be 5% by volume or more. The porosity can be 20% by volume or less. The "vertex side region of protrusion" means a region in the resin particle that forms the protrusion of the surface layer included in the charging member, the region corresponding to 11% by volume of the solid particle assuming that the resin particle is a solid particle having no pores, and being farthest away from the electro-conductive substrate. The "vertex side region of protrusion" is specifically a region 18 in FIG. 7. The method of measuring the porosity in the "vertex side region of protrusion" will be described later (see Examples).

In the present invention, for example, by forming the surface layer using the porous particle described later, a surface layer having a protrusion derived from the resin particle having a plurality of pores inside thereof can be formed. The porous particle has a plurality of pores (through holes) having regions containing air inside thereof. In the forming process of the surface layer, a binder resin or the like may invade into the pores, but the pores can be prevented from being embedded completely by adjusting the conditions for production of the surface layer. For this reason, the pores can exist inside of the resin particle that forms the protrusion in the surface layer.

Regarding the number of the remaining pores and the size thereof, by controlling the kind of the coating solution for forming a surface layer containing the porous particle, the electron conductive agent and the binder resin, the coating conditions, and the drying conditions for the coating of the coating solution, for example, the pore diameter and the porosity can be controlled.

The method of forming the surface layer according to the present invention can be any method as long as the method allows the resin particle having a plurality of pores inside thereof that produces the protrusion in the surface of the charging member to exist inside of the surface layer. Specifically, examples of the method include a dip coating method using a coating solution for forming a surface layer and a ring coating method using a ring-shape coating head.

In the present invention, more preferably, the pores contained inside of the resin particle that produces the protrusion in the surface of the charging member concentrate on the "vertex side region of protrusion" of the resin particle. When the charging member in such a state is brought into contact with the electrophotographic photosensitive member, only the portion in the vicinity of the vertex of the protrusion derived from the resin particle distorts. For this reason, without reducing discharge within the nip, an effect of suppressing the slip between the electrophotographic photosensitive member and the charging member can be more surely exhibited.

Figure 3:
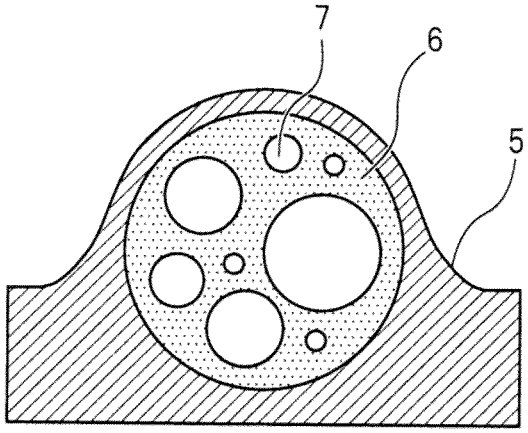
FIG. 3 is a sectional view of a hollow particle dispersed in the surface layer formed in the charging roller according to the present invention.

FIG. 3 is a cross sectional view of a portion in the vicinity of the protrusion derived from the hollow particle in the surface layer formed using the hollow particle.

Hereinafter, the "porous particle" and "hollow particle" as raw materials for the resin particle in the surface layer according to the present invention will be described in detail.

[Porous Particle]

In the porous particle, the porosity of the outer layer portion of the particle can be larger than that of the inner layer portion of the particle, and the pore diameter of the outer layer portion of the particle is larger than that of the inner layer portion of the particle. Use of the porous particle having such a core shell structure can lead to the state illustrated in FIG. 2A. Alternatively, use of the porous particle having no core shell structure can lead to the state illustrated in FIG. 2B.

Examples of the material for the porous particle can include acrylic resins, styrene resins, acrylonitrile resins, vinylidene chloride resins, and vinyl chloride resins. These resins can be used alone or in combination of two or more. Further, monomers that are raw materials for these resins may be copolymerized and used as copolymers. These resins may be used as the main component, and other known resins may be contained when necessary.

The porous particle according to the present invention can be produced by a known production method such as a suspension polymerization method, an interface polymerization method, an interface precipitation method, a liquid drying method, or a method in which a solute or solvent for reducing the solubility of a resin is added to a resin solution to precipitate the resin. For example, in the suspension polymerization method, in the presence of a crosslinkable monomer, a porosifying agent is dissolved in a polymerizable monomer to prepare an oily mixed solution. Using the oily mixed solution, aqueous suspension polymerization is performed in an aqueous medium containing a surfactant and a dispersion stabilizer. After completion of the polymerization, water and the porosifying agent can be removed by washing and drying to obtain a resin particle. A compound having a reactive group reactive with a functional group in the polymerizable monomer and an organic filler can be added. To form micropores inside of the porous particle, the polymerization can be performed in the presence of the crosslinkable monomer.

Examples of the polymerizable monomer include: styrene monomers such as styrene, p-methyl styrene, and p-tert-butyl styrene; and (meth)acrylic acid ester monomers such as methyl acrylate, ethyl acrylate, propyl acrylate, butyl acrylate, 2-ethylhexyl acrylate, lauryl acrylate, methyl methacrylate, ethyl methacrylate, propyl methacrylate, butyl methacrylate, isobutyl methacrylate, tert-butyl methacrylate, benzyl methacrylate, phenyl methacrylate, isobornyl methacrylate, cyclohexyl methacrylate, glycidyl methacrylate, hydrofurfuryl methacrylate, and lauryl methacrylate. These polymerizable monomers are used alone, or may be used in combination of two or more when necessary. In the present invention, the term "(meth)acrylic" is a concept including both acrylic and methacrylic.

The crosslinkable monomer is not particularly limited as long as the crosslinkable monomer has a plurality of vinyl groups, and examples thereof can include: (meth)acrylic acid ester monomers such as ethylene glycol di(meth)acrylate, diethylene glycol di(meth)acrylate, triethylene glycol di(meth)acrylate, decaethylene glycol di(meth)acrylate, pentadecaethylene glycol di(meth)acrylate, pentacontahectaethylene glycol di(meth)acrylate, 1,3-butylene glycol di(meth) acrylate, 1,4-butanediol di(meth)acrylate, 1,6-hexanediol di(meth)acrylate, glycerin di(meth)acrylate, allyl methacrylate, trimethylolpropane tri(meth)acrylate, pentaerythritol tetra(meth)acrylate, phthalic acid diethylene glycol di(meth) acrylate, caprolactone-modified dipentaerythritol hexa (meth)acrylate, caprolactone-modified hydroxy pivalic acid ester neopentyl glycol diacrylate, polyester acrylate, and urethane acrylate; divinylbenzene, divinylnaphthalene, and derivatives thereof. These can be used alone or in combination of two or more.

The crosslinkable monomer can be used such that the content in the monomer mixture is 5% by mass or more and 90% by mass or less. At a content within this range, the micropores can be surely formed inside of the porous particle.

As the porosifying agent, a non-polymerizable solvent, a mixture of a linear polymer dissolved in a mixture of polymerizable monomers and a non-polymerizable solvent, and a cellulose resin can be used.

Examples of the non-polymerizable solvent can include: toluene, benzene, ethyl acetate, butyl acetate, normal hexane, normal octane, and normal dodecane.

The cellulose resin is not particularly limited, and examples thereof can include ethyl cellulose. These porosifying agents can be used alone or in combination of two or more.

The amount of the porosifying agent to be added can be properly selected according to the purpose of use. The porosifying agent can be used in the range of 20 parts by mass to 90 parts by mass in 100 parts by mass of an oil phase including the polymerizable monomer, the crosslinkable monomer, and the porosifying agent. At the amount within this range, the porous particle is prevented from being fragile, and a gap is easily formed in the nip between the charging member and the electrophotographic photosensitive member.

The polymerization initiator is not particularly limited, and those soluble in the polymerizable monomer can be used. Known peroxide initiators and azo initiators can be used, and examples thereof can include: 2,2'-azobisisobutyronitrile, 1,1'-azobiscyclohexane-1-carbonitrile, 2,2'-azobis-4-methoxy-2,4-dimethylvaleronitrile, and 2,2'-azobis-2,4-dimethylvaleronitrile.

Examples of the surfactant can include: anionic surfactants such as sodium lauryl sulfate, polyoxyethylene (polymerization degree: 1 to 100) sodium lauryl sulfate, and polyoxyethylene (polymerization degree: 1 to 100) lauryl sulfate triethanolamine; cationic surfactants such as stearyl trimethyl ammonium chloride, stearic acid diethylaminoethylamide lactic acid salt, dilaurylamine hydrochloride, and oleylamine lactic acid salt; nonionic surfactants such as adipic acid diethanol amine condensates, lauryldimethylamine oxides, glyceryl monostearate, sorbitan monolaurate, and stearic acid diethylaminoethylamide lactic acid salt; amphoteric surfactants such as palm oil fatty acid amide propyl dimethyl amino acetic acid betaine, lauryl hydroxysulfobetaine, and sodium β-laurylaminopropionate; and high molecular dispersants such as polyvinyl alcohol, starch, and carboxymethylcellulose.

Examples of the dispersion stabilizer can include: organic fine particles such as polystyrene fine particles, polymethyl methacrylate fine particles, polyacrylic acid fine particles, and polyepoxide fine particles; silica such as colloidal silica; calcium carbonate, calcium phosphate, aluminum hydroxide, barium carbonate, and magnesium hydroxide.

Among the polymerization methods, particularly a specific example of the suspension polymerization method will be described below. The suspension polymerization can be performed under a sealing condition using a pressure-resistant container. Prior to the polymerization, the raw material component may be suspended with a dispersing machine, the suspension may be placed in a pressure-resistant container and suspension polymerized; or the reaction solution may be suspended in a pressure-resistant container. The polymerization temperature is more preferably 50° C. to 120° C. The polymerization may be performed under atmospheric pressure. To prevent the porosifying agent from becoming gaseous, the polymerization can be performed under increased pressure (under a pressure atmospheric pressure plus 0.1 to 1 MPa). After the polymerization is completed, solid liquid separation and washing may be performed by centrifugation or filtering. After solid liquid separation and washing, the obtained product may be dried or crushed at a temperature equal to or less than the softening temperature of the resin that forms the resin particle. Drying and crushing can be performed by a known method, and an air dryer, a fair wind dryer, and a Nauta Mixer can be used. Drying and crushing can be performed at the same time with a crusher dryer. The surfactant and the dispersion stabilizer can be removed by repeating washing and filtering after production.

The particle diameter of the porous particle can be adjusted according to the mixing conditions for the oily mixed solution including the polymerizable monomer and the porosifying agent and the aqueous medium containing the surfactant and the dispersion stabilizer, the amount of the dispersion stabilizer to be added, and the stirring and dispersing conditions. If the amount of the dispersion stabilizer to be added is increased, the average particle diameter can be decreased. In the stirring and dispersing conditions, if the stirring rate is increased, the average particle diameter of the porous particle can be decreased. The porous particle according to the present invention preferably has a volume average particle diameter in the range of 5 to 60 μm. Furthermore, the volume average particle diameter is more preferably in the range of 10 to 50 μm. At a volume average particle diameter within this range, the discharge within the nip can be generated more stably. The volume average particle diameter can be measured by the method described in Examples described later.

The micropore diameter and the inner pore diameter of the porous particle, and the proportion of the region containing air can be adjusted according to the amount of the crosslinkable monomer to be added, and the kind and amount of the porosifying agent to be added.

The pore diameter can be reduced if the amount of the crosslinkable monomer to be added is increased. The micropore diameter can be further increased if a cellulose resin is used as the porosifying agent.

The micropore diameter of the porous particle is preferably 10 to 500 nm, and within the range of 20% or less based on the average particle diameter of the resin particle. Furthermore, the micropore diameter is more preferably 20 to 200 nm, and within the range of 10% or less based on the average particle diameter of the resin particle. At a micropore diameter within this range, addition of the porous particle to the surface layer can lead to the state illustrated in FIG. 2B in which the inner layer portion of the resin particle has a plurality of pores. The inner pore diameter inside of the resin particle that forms the protrusion is preferably 60 to 300 nm. The inner pore diameter is more preferably 80 to 150 nm. If the more preferable range is met, the hardness of the protrusion derived from the resin particle can be reduced to increase the distortion of the protrusion in contact with the electrophotographic photosensitive member. As a result, the contact state of the electrophotographic photosensitive member and the charging member is stabilized.

As described above, to form the state illustrated in FIG. 2A where the pores inside of the resin particle concentrate on the "vertex side region of protrusion" of the resin particle, the porosity and pore diameter in the outer layer portion of the resin particle can be larger than those in the inner layer portion of the resin particle.

The porous particle used in the present invention having an porosity in the outer layer portion larger than that in the inner layer portion and a pore diameter in the outer layer portion larger than that in the inner layer portion can be produced by using two porosifying agents, and particularly two porosifying agents having different solubility parameters (hereinafter referred to as an "SP value").

As a specific example, an example in which normal hexane and ethyl acetate are used as the porosifying agents will be described below. When the two porosifying agents are used and the oily mixed solution of the polymerizable monomer and the porosifying agents is added to an aqueous medium, a large amount of the ethyl acetate having an SP value close to that of water exists on the aqueous medium side, namely, in the outer layer portions of suspended droplets. In contrast, a larger amount of the normal hexane exists in the inner layer portions of the droplets. The ethyl acetate existing in the outer layer portions of the droplets has an SP value close to that of water, and therefore water is dissolved in the ethyl acetate in a certain degree. In this case, the solubility of the porosifying agent in the polymerizable monomer is lower in the outer layer portions of the droplets than in the inner layer portions of the droplets. As a result, the polymerizable monomer is separated from the porosifying agents more easily than in the inner layer portions. Namely, the porosifying agent is more likely to exist as a larger bulk in the outer layer portions of the droplets than in the inner layer portions. Thus, the above polymerization reaction, and further a post treatment are performed in the state where the porosifying agents are controlled to exist in the inner layer portions of the droplets differently from in the outer layer portions. Thereby, the porous particle having the core shell structure above can be produced.

Accordingly, if one of the two porosifying agents is the porosifying agent having an SP value close to that of water as the medium, the pore diameter in the outer layer portion of the porous particle and the porosity can be increased. Examples of preferable porosifying agents used in the above method can include ethyl acetate, methyl acetate, propyl acetate, isopropyl acetate, butyl acetate, acetone, and methyl ethyl ketone. If the other porosifying agent to be used has high solubility in the polymerizable monomer and the difference in the SP value between the porosifying agent and water is larger, the porous particle having the core shell structure described above can be produced. Examples of preferable porosifying agents used in the above method can include normal hexane, normal octane, and normal dodecane.

[Hollow Particle]

Examples of the material for the hollow particle can include the same resins as those for the porous particle. These resins can be used alone or in combination of two or more. Further, monomers that are raw materials for these resins may be copolymerized and used as copolymers. These resins may be used as the main component, and other known resins may be contained when necessary.

The hollow particle according to the present invention can be produced by a known production method such as a suspension polymerization method, an interface polymerization method, an interface precipitation method, and a liquid drying method. Among these production methods, examples of a preferable suspension polymerization method include the production method (a) below.

(a) Method Using Aqueous Medium

In the presence of a crosslinkable monomer, an oily mixed solution of a hydrophobic polymerizable monomer (hydrophobic monomer), a hydrophilic polymerizable monomer (hydrophilic monomer), and a polymerization initiator is prepared. The oily mixed solution is subjected to aqueous suspension polymerization in an aqueous medium solution containing a dispersion stabilizer. After the polymerization is completed, the obtained product is washed and dried to obtain a hollow particle.

According to the method, when the oily mixed solution is mixed with the aqueous medium solution during the polymerization process, water invades into droplets of the oily mixed solution. Subsequently, the polymerizable monomer in the droplets containing water is polymerized to form a resin particle containing water. The resin particle is dried at a temperature of 100° C. or more to vaporize water inside of the resin particle. Thereby, the non-through holes can be formed inside of the resin particle. It is thought that water still remains inside of the resin particle after the drying, and no through holes are formed. Alternatively, water is added to the oily mixed solution to prepare an emulsified mixed solution in advance, and the emulsified mixed solution is dispersed in the aqueous medium solution. Then, the obtained solution is suspension polymerized. Thereby, the hollow particle can also be obtained.

In this case, the hydrophobic monomer can be controlled to be 70% by mass to 99.5% by mass based on the total of the hydrophobic monomer and the hydrophilic monomer, and the hydrophilic monomer is controlled to be 0.5% by mass to 30% by mass based on the total of the hydrophobic monomer and the hydrophilic monomer. This facilitates formation of the hollow particle.

Examples of the hydrophobic monomer include (meth) acrylic acid ester monomers, polyfunctional (meth)acrylic acid ester monomers, styrene monomers such as styrene, p-methyl styrene, and α-methyl styrene, and vinyl acetate. Among these, from the viewpoint of pyrolysis properties, (meth)acrylic acid ester monomers are preferable, and methacrylic acid ester monomers are more preferable. Examples of (meth)acrylic acid ester monomers include: methyl (meth) acrylate, ethyl (meth)acrylate, propyl (meth)acrylate, n-butyl (meth)acrylate, isobutyl (meth)acrylate, hexyl (meth)acrylate, octyl (meth)acrylate, 2-ethylhexyl (meth)acrylate, and lauryl (meth)acrylate. These hydrophobic monomers may be used in combination of two or more.

Examples of the hydrophilic monomer include hydroxyl group-terminated polyalkylene glycol mono(meth)acrylate such as polyethylene glycol mono(meth)acrylate, polypropylene glycol mono(meth)acrylate, poly(ethylene glycol-propylene glycol) mono(meth)acrylate, polyethylene glycol-polypropylene glycol mono(meth)acrylate, poly(meth) acrylate, poly(propylene glycol-tetramethylene glycol) mono (meth)acrylate, and propylene glycol polybutylene glycol mono(meth)acrylate. These may be used in combination of two or more.

As the crosslinkable monomer, the same monomers as those used to produce the porous particle can be used. The content can be adjusted to be 0.5% by mass to 60% by mass based on the total of the hydrophobic monomer and the hydrophilic monomer. At a content within this range, the pores can be surely formed inside of the porous particle.

As the polymerization initiator, the surfactant, and the dispersion stabilizer, the same compounds as those used to produce the porous particle can be used. The polymerization initiators, dispersion stabilizers, and surfactants above may be used alone or in combination of two or more. The proportion of the polymerization initiator to be used can be 0.01 parts by mass to 2 parts by mass based on 100 parts by mass of the monomer. The proportion of the dispersion stabilizer to be used can be 0.5 parts by mass to 30 parts by mass based on 100 parts by mass of the monomer. The proportion of the surfactant to be used can be 0.001 parts by mass to 0.3 parts by mass based on 100 parts by mass of water.

The polymerization reaction is performed: the oily mixed solution is mixed with the aqueous medium, and then the temperature is raised while the mixed solution is being stirred. The polymerization temperature can be 40° C. to 90° C., and the polymerization time is approximately one hour to 10 hours. At a polymerization temperature and time within these ranges, the pores (non-through holes) can be surely formed inside of the hollow particle. At this time, by controlling the mixing conditions for the monomer and water and stirring conditions, the average particle size of the hollow particle can be properly determined.

The average diameter of the pores (non-through holes) contained in the hollow particle is preferably 0.05 μm or more and 15 μm or less. The average diameter is more preferably 0.1 μm or more and 10 μm or less. At an average diameter within this range, the hardness of the protrusion derived from the resin particle reduces to increase the distortion of the protrusion. As a result, an electrical attractive force increases, enabling a more stable contact state of the electrophotographic photosensitive member and the charging member.

[Binder Resin]

Examples of the binder resin include known rubber or resin. Examples of rubber can include natural rubber, vulcanized natural rubber, and synthetic rubber.

Examples of the synthetic rubber include: ethylene propylene rubber, styrene butadiene rubber (SBR), silicone rubber, urethane rubber, isoprene rubber (IR), butyl rubber, acrylonitrile butadiene rubber (NBR), chloroprene rubber (CR), acrylic rubber, epichlorohydrin rubber, and fluorine rubber.

For the resin, resins such as thermosetting resins and thermoplastic resins can be used. Among these, fluorinated resins, polyamide resins, acrylic resins, polyurethane resins, acrylic urethane resins, silicone resins, and butyral resin are more preferable, and acrylic resins and polyurethane resins are particularly preferable. Use of these resins stabilizes the contact state of the charging member and the electrophotographic photosensitive member, and facilitates suppression of the slip.

These may be used alone or in a mixture of two or more. The monomers that are raw materials for these binder resins may be copolymerized to prepare copolymers. Among these, the resins above are preferably used as the binder resin. This is because adhesion and friction properties to the electrophotographic photosensitive member can be controlled more easily.

[Electron Conductive Agent]

Examples of the electron conductive agent include: fine particles and fibers of metals such as aluminum, palladium, iron, copper, and silver; metal oxides such as titanium oxide, tin oxide, and zinc oxide; composite particles of the metallic fine particles, fibers and metal oxides surface treated by electrolysis, spray coating, or mixing and shaking; furnace black, thermal black, acetylene black, and ketjen black; and carbon powders such as PAN (polyacrylonitrile) carbons and pitch carbons. Examples of furnace black include: SAF-HS, SAF, ISAF-HS, ISAF, ISAF-LS, I-ISAF-HS, HAF-HS, HAF, HAF-LS, T-HS, T-NS, MAF, FEF, GPF, SRF-HS-HM, SRF-LM, ECF, and FEF-HS. Examples of thermal black include FT and MT.

These electron conductive agents can be used alone or in combination of two or more. The average primary particle diameter of the electron conductive agent is more preferably 0.01 μm to 0.9 μm, and still more preferably 0.01 μm to 0.5 μm. At an average primary particle diameter within this range, the volume resistivity of the surface layer in the charging member is easily controlled. The average primary particle diameter of the electron conductive agent in the surface layer is measured as follows, for example. Namely, a test piece having a thickness of approximately 100 nanometers using a microtome is cut out, and an enlarged image of the test piece is photographed at a magnification of 80000 to 100000 using an electron microscope. From the obtained photograph, 100 electron conductive agents that do not aggregate are selected. In each of the selected electron conductive agents, considering the longest length in the photograph as the diameter of the electron conductive agent, the value of the diameter of the electron conductive agent is calculated based on the magnification of the photograph. The arithmetic average value of the diameters of the electron conductive agents calculated is defined as the average primary particle diameter of the electron conductive agents contained in the test piece.

The content of the electron conductive agents in the surface layer is suitably in the range of 2 parts by mass to 80 parts by mass, and preferably 20 parts by mass to 60 parts by mass based on 100 parts by mass of the binder resin.

The surface of the electron conductive agent may be surface treated. As a surface treatment agent, organic silicon compounds such as alkoxysilane, fluoroalkylsilane, and polysiloxane; a variety of coupling agents such as silane coupling agents, titanate coupling agents, aluminate coupling agents, and zirconate coupling agents; oligomers or high molecular compounds can be used. These may be used alone or in combination of two or more. The surface treatment agent is preferably organic silicon compound such as alkoxysilane and polysiloxane; a variety of coupling agents such as silane coupling agents, titanate coupling agents, aluminate coupling agents, or zirconate coupling agents, and more preferably organic silicon compounds. Use of the surface treatment agent improves the dispersibility of the electron conductive agent, and desired electrical properties are easily attained.

When carbon black is used as the electron conductive agent, a composite conductive fine particle prepared by coating a metal oxide fine particle with carbon black is more preferably used. Carbon black forms a structure, and therefore tends to be difficult to uniformly exist in the binder resin. Use of the composite conductive fine particle prepared by coating a metal oxide with carbon black enables the electron conductive agent to uniformly exist in the binder resin, and the volume resistivity of the surface layer in the charging member is controlled more easily.

[Other Materials]

The surface layer in the charging member according to the present invention may contain an insulation particle in addition to the electron conductive agent. Examples of a material for the insulation particle include: zinc oxide, tin oxide, indium oxide, titanium oxides (such as titanium dioxide and titanium monooxide), iron oxide, silica, alumina, magnesium oxide, zirconium oxide, strontium titanate, calcium titanate, magnesium titanate, barium titanate, calcium zirconate, barium sulfate, molybdenum disulfide, calcium carbonate, magnesium carbonate, dolomite, talc, kaolin clay, mica, aluminum hydroxide, magnesium hydroxide, zeolite, wollastonite, diatomite, glass beads, bentonite, montmorillonite, hollow glass balls, organic metal compounds, and organic metal salts. Moreover, iron oxides such as ferrite, magnetite, and hematite and activated carbon can be used.

The surface layer in the charging member may further contain a mold release agent to improve releasing properties. The surface layer containing the mold release agent can prevent dirt from adhering to the surface of the charging member to improve the durability of the charging member. When the mold release agent is a liquid, the mold release agent also acts as a leveling agent in formation of the surface layer. The surface layer may be surface treated. Examples of the surface treatment can include surface machining using UV or an electron beam and surface modification by applying a compound to the surface and/or impregnating the surface with a compound.

[Electro-Conductive Substrate]

The electro-conductive substrate in the charging member has conductivity, and has a function to support the surface layer disposed thereon. Examples of materials for the electro-conductive substrate can include metals such as iron, copper, stainless steel, aluminum, and nickel and alloys thereof. To give scratch resistance, the surface of the electro-conductive substrate may be plated in the range in which conductivity is not impaired. Furthermore, as the electro-conductive substrate (electro-conductive shaft), substrates prepared by coating the surface of a resin base material with a metal to make the surface electro-conductive and those produced with a conductive resin composition can also be used.

[Electro-Conductive Elastic Layer]

In the charging member according to the present invention, an electro-conductive elastic layer can be disposed between the electro-conductive substrate and the surface layer when necessary. As the electro-conductive elastic layer, a material made of a mixture of a resin (rubber) and a conductive substance is typically used. As the resin (rubber), acrylonitrile butadiene rubber, acrylic rubber, epichlorohydrin rubber, urethane rubber, ethylene propylene rubber, styrene butadiene rubber, silicone rubber, and acrylic rubber can be used. These may be used alone or in a mixture of two or more. More preferable resins (rubbers) are acrylonitrile butadiene rubber, acrylic rubber, and epichlorohydrin rubber.

The conductive material applicable to the conductive elastic layer is classified into two: an electron conductive agent and an ionic conductive agent. Examples of the electron conductive agent include fine particles and fibers of metals such as aluminum, palladium, iron, copper, and silver; metal oxides such as titanium oxide, tin oxide, and zinc oxide; metallic fine particles, carbon black, and carbon fine particles. These can be used alone or in combination of two or more. Among these electron conductive agents, carbon black is suitably used because carbon black can keep electric resistance for a long period. This is because the resistance of carbon black will not increase due to oxidation. The amount of the electron conductive agent contained in the electro-conductive elastic layer is suitably in the range of 2 parts by mass to 200 parts by mass, and preferably 5 parts by mass to 100 parts by mass based on 100 parts by mass of the resin (rubber).

Examples of the ionic conductive agent include inorganic ion substances such as lithium perchlorate, cationic surfactants such as modified aliphatic dimethylethylammonium ethosulfate, amphoteric ion surfactants such as dimethyl alkyl lauryl betaine, quaternary ammonium salts such as trimethyloctadecylammonium perchlorate, and organic acid lithium salts such as lithium trifluoromethanesulfonate. These can be used alone or in combination of two or more. Among these ionic conductive agents, particularly perchloric acid quaternary ammonium salts are suitably used because the resistance is stable against environmental changes. The amount of the ionic conductive agent contained in the electro-conductive elastic layer is in the range of 0.01 parts by mass to 5 parts by mass, and preferably 0.1 parts by mass to 2 parts by mass based on 100 parts by mass of the resin (rubber).

The electro-conductive substrate may be bonded to the electro-conductive elastic layer disposed thereon with an electro-conductive adhesive layer. In this case, a conductive adhesive can be used to form the electro-conductive adhesive layer. To make the adhesive conductive, a known conductive agent can be used. Examples of the binder for the adhesive include thermosetting resins and thermoplastic resins. Known urethane resins, acrylic resins, polyester resins, polyether resins, and epoxy resins can be used. The conductive agent for giving conductivity to the adhesive can be properly selected from the electron conductive agents and the ionic conductive agents. These selected conductive agents can be used alone or in combination of two or more.

[Method of Producing Charging Member]

The charging member according to the present invention can be produced by forming the surface layer on the electro-conductive substrate, or by forming the electro-conductive elastic layer on the electro-conductive substrate and further forming the surface layer on the electro-conductive elastic layer.

[Method of Forming Electro-Conductive Elastic Layer]

First, as a material for forming the electro-conductive elastic layer, a resin (rubber), a conductive agent, a plasticizer, an extender, and a variety of additives (such as a vulcanizing agent, a vulcanization accelerator, an antioxidant, and a foaming agent) are kneaded with a kneader to prepare a raw material rubber composition. Examples of the kneader include a ribbon blender, a Nauta Mixer, a Henschel mixer, a SUPERMIXER, a Banbury mixer, and a pressure kneader. In the step of kneading the vulcanizing agent and the vulcanization accelerator, an open roll mill is desirably used for kneading to prevent the vulcanization of the resin (rubber) from being accelerated by an increase in the temperature.

Examples of a method of forming the electro-conductive elastic layer from the raw material rubber composition include a method in which using an extrusion molding apparatus including a crosshead, an electro-conductive substrate having an adhesive applied thereto is used as a center shaft and the raw material rubber composition is cylindrically applied to the shaft to integrally extrude the electro-conductive substrate and the raw material rubber composition thereby to produce the electro-conductive elastic layer. The crosshead is an attachment usually used for coating of electric wires and wires. In use, the crosshead is mounted on the rubber discharging unit of the cylinder in the extruder.

Another example thereof include a method in which a rubber tube is formed from the raw material rubber composition, an electro-conductive substrate having an adhesive applied thereto is inserted into the tube, and the electro-conductive substrate is bonded to the tube. Another example thereof include a method in which an electro-conductive substrate having an adhesive applied thereto is coated with an unvulcanized rubber sheet, and vulcanized within a metal mold.

The surface of the obtained charging member may be polished. As a cylinder polisher for forming a predetermined outer diameter, a traverse mode NC cylinder polisher, a plunge cutting mode NC cylinder polisher, and the like can be used. The plunge cutting mode NC cylinder polisher is preferable because the plunge cutting mode NC cylinder polisher using a wider polishing grinding wheel than that in the traverse mode can shorten the process time, and hardly changes the diameter of the polishing grinding wheel.

[Method of Forming Surface Layer]

Examples of the method of forming the surface layer can include the following method. First, the electro-conductive elastic layer is formed on the electro-conductive substrate by the method above or the like. Next, the surface of the elastic layer is coated with a layer of a coating solution for a surface layer described later, and dried, cured, or crosslinked. As the coating method, electrostatic spray coating, dipping coating, roll coating, and a method of bonding or coating a sheet-like or tubular layer formed into a predetermined layer thickness are used. Alternatively, a coating solution for a surface layer is disposed in the outer peripheral portion of the elastic layer within a mold and cured.

When these coating methods are used, a "coating solution for a surface layer" is prepared by dispersing the resin particle and the electron conductive agent such as an ionic conductive agent and a conductive fine particle in the binder resin. For easier control of the porosity of the resin particle, a solvent can be used for the coating solution. Particularly, a polar solvent enabling dissolution of the binder resin and having high affinity with the resin particle can be used. Specifically, examples of the solvent include: ketones such as acetone, methyl ethyl ketone, methyl isobutyl ketone, and cyclohexanone; alcohols such as methanol, ethanol, and isopropanol; amides such as N,N-dimethylformamide and N,N-dimethylacetamide; sulfoxides such as dimethyl sulfoxide; ethers such as tetrahydrofuran, dioxane, and ethylene glycol monomethyl ether; and esters such as methyl acetate, and ethyl acetate.

As the method of dispersing the binder resin, the resin particle and the electron conductive agent such as an ionic conductive agent and a conductive fine particle in the coating solution, a solution disperse apparatus such as a ball mill, a sand mill, a paint shaker, a DYNO-MILL, and a pearl mill can be used.

A specific example of the method of forming the surface layer will be described below. First, disperse components other than the resin particle such as a conductive fine particle are mixed with glass beads having a diameter of 0.8 mm, and dispersed in the binder resin over 5 to 36 hours using a paint shaker dispersing machine. Next, the resin particle is added, and dispersed. The dispersion time can be 2 minutes or more and 30 minutes or less. Here, conditions need to be set not to crush the resin particle. Subsequently, the viscosity is adjusted to be 3 to 30 mPa·s, and more preferably 3 to 20 mPa·s to obtain a coating solution for a surface layer. Next, the surface layer can be formed on the electro-conductive elastic layer by dipping such that the layer thickness after drying is 0.5 to 50 μm, more preferably 1 to 20 μm, and particularly preferably 1 to 10 μm.

The layer thickness of the surface layer can be measured by cutting out a cross section of the charging member with a sharp knife and observing the cross section with an optical microscope or an electron microscope. Any three points in the longitudinal direction of the charging member and three points in the circumferential direction thereof, nine points in total are measured, and the average value thereof is defined as the layer thickness.

When the layer thickness is thick, namely, the amount of the solvent in the coating solution is small, air bubbles may be produced in the surface layer easily. Accordingly, the concentration of the solid content in the coating solution can be relatively small. The proportion of the solvent to the coating solution is preferably 40% by mass or more, more preferably 50% by mass or more, and particularly preferably 60% by mass or more.

The specific gravity of the coating solution is adjusted to be preferably 0.8000 or more and 1.200 or less, and more preferably 0.9000 or more and 1.000 or less. At a specific gravity within this range, a flow of the coating solution easily generates, and air bubbles are easily removed. The difference between the specific gravity of the resin particle and the specific gravity of the coating solution is controlled to be smaller. Thereby, the flow of the coating solution causes the resin particle to move easily, suppressing sedimentation of the resin particle. Accordingly, a smaller difference is more preferable.

After the coating solution is applied, the coating solution can be once dried in an environment of a temperature of approximately 20 to 50° C. When a treatment such as curing or crosslinking is performed, the treatment can be performed after the drying. If a high temperature (e.g. boiling point or more of the solvent) is applied immediately after application of the coating solution, the solvent will bump, leading to difficulties to uniformly form the coating. This is not preferable. When a high temperature is needed for curing or crosslinking, to prevent the bumping, the coating can be subjected to pre-drying in an environment of approximately 20 to 30° C. before curing. Thereby, a uniform coating can be formed surely.

In the present invention, as illustrated in FIG. 2A, the resin particle exists inside of the surface layer, in which the pores concentrate on the vertex side region of protrusion of the resin particle. To attain such a state of the resin particle, a porous particle having a porosity in the outer layer portion larger than that in the inner layer portion and a pore diameter in the outer layer portion larger than that in the inner layer portion can be used as a raw material for the resin particle.

When the surface layer is formed using such a porous particle, the porosity is more easily controlled in the protrusion of the surface of the charging member. The reason is described below using FIGS. 10A to 10E.

Figure 10A:
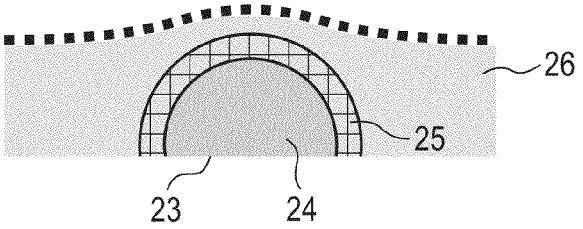
FIG. 10A is a diagram for describing a binder resin and a flow of a solvent in a coating formed of a coating solution for forming a surface layer according to the present invention in a drying step.
Figure 10B:
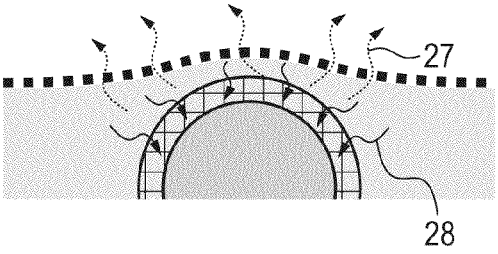
FIG. 10B is a diagram for describing a binder resin and a flow of a solvent in a coating formed of a coating solution for forming a surface layer according to the present invention in a drying step.

FIG. 10A is a schematic view illustrating a state immediately after a coating 26 of the coating solution for a surface layer is applied onto the surface of the electro-conductive substrate or the surface of the electro-conductive elastic layer by the coating method above. The coating 26 contains the solvent, the binder resin, the electron conductive agent, and a porous particle 23. The porous particle 23 is formed of an inner layer region 24 and an outer layer region 25. The state in FIG. 10A illustrates that in the porous particle, the porosity in the outer layer region is larger than that in the inner layer region, and the pore diameter in the outer layer region is larger than that in the inner layer region. In this state, it is presumed that at least the solvent and the binder resin uniformly permeate through the inside of the pores in the porous particle. Immediately after the coating solution is applied to the surface of the electro-conductive substrate, the solvent in the coating solution starts volatilizing from and the surface of the electro-conductive substrate. At this time, volatilization of the solvent progresses in the direction of the arrow 27 in FIG. 10B, and the concentration of the binder resin will increase on the side of the surface of the coating 26. Inside of the coating, a force acts to keep the concentration of the solvent and that of the binder resin constant, causing the binder resin in the coating to flow in the direction of the arrow 28.

Figure 10C:
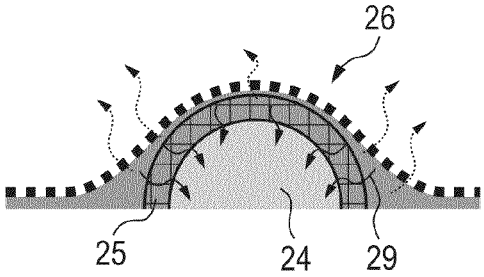
FIG. 10C is a diagram for describing a binder resin and a flow of a solvent in a coating formed of a coating solution for forming a surface layer according to the present invention in a drying step.

The inner layer region 24 in the porous particle has a pore diameter smaller than that in the outer layer region 25 and a porosity smaller than that in the outer layer region 25. For this reason, the moving speeds of the solvent and binder resin in the inner layer region 24 are slower than those of the solvent and binder resin in the outer layer region 25. Accordingly, while the binder resin moves in the direction of the arrow 28, the difference in the moving speeds of the binder resin in the inner layer region of the porous particle and the outer layer region thereof causes a state where the concentration of the binder resin in the outer layer region is higher than the concentration of the binder resin in the inner layer region. FIG. 10C illustrates a state where the concentration of the binder resin in the outer layer region 25 is higher than that in the inner layer region 24.

Then, a flow 29 of the binder resin will occur in a direction to relax the difference in the concentration of the binder resin between the inner layer region of the porous particle and the outer layer region thereof. Because the volatilization of the solvent always progresses in the direction of the arrow 27, the porous particle becomes the state illustrated in FIG. 10D in which the concentration of the binder resin in the outer layer region is lower than in the inner layer region of the porous particle.

Figure 10D:
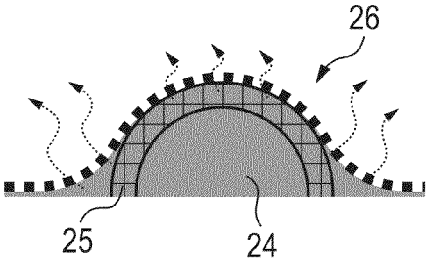
FIG. 10D is a diagram for describing a binder resin and a flow of a solvent in a coating formed of a coating solution for forming a surface layer according to the present invention in a drying step.
Figure 10E:
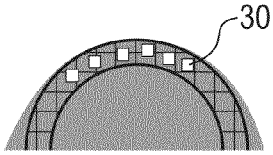
FIG. 10E is a diagram for describing a binder resin and a flow of a solvent in a coating formed of a coating solution for forming a surface layer according to the present invention in a drying step.

In the state illustrated in FIG. 10D, the coating is dried, cured, or crosslinked at a temperature of the boiling point or more of the solvent used. Thereby, the solvent remaining in the outer layer region of the porous particle volatilizes all at once, and finally pores 30 can be formed in the outer layer region of the porous particle.

The present inventors consider that use of the method above enables ensuring control of the porosity in the protrusion in the charging member.

For easier control of the porosity, more preferably, the porosities and ratio of the pore diameters in the inner layer region and outer layer region of the porous particle are controlled. Namely, the porosity in the outer layer portion can be 1.5 times or more and 3 times or less the porosity in the inner layer portion, and the pore diameter in the outer layer portion can be 2 times or more and 10 times or less the pore diameter in the inner layer portion. To control the flow of the solvent, the polar solvent having high affinity with the porous particle can be used. Among these solvents, use of ketones and esters are more preferable.

In the drying, curing, or crosslinking step after the coating solution for a surface layer is applied, the temperature and time can be controlled. By controlling the temperature and time, the moving speeds of the solvent and the binder resin can be controlled. Specifically, the step after formation of the coating can include three or more steps. The state of the step after formation of the coating including three or more steps will be described in detail.

In a first step, after formation of the coating, the coating can be left as it is under a room temperature atmosphere for 15 minutes or more and one hour or less. Thereby, it is easy to form the state illustrated in FIG. 10B mildly.

In a second step, the coating can be left as it is for 15 minutes or more and one hour or less at a temperature of room temperature or more and the boiling point or less of the solvent to be used. Depending somewhat on the kind of solvents to be used, specifically, the temperature is more preferably controlled to be 40° C. or more and 100° C. or less, and the coating is left as it is for 30 minutes or more and 50 minutes or less. The second step can accelerate the volatilizing speed of the solvent in the FIG. 10C and control to increase the concentration of the binder resin in the inner layer region 24 of the porous particle more easily.

A third step is a step of drying, curing, or crosslinking the coating at a temperature of the boiling point or more of the solvent. At this time, the temperature in the third step can be rapidly raised from that in the second step and controlled. Thereby, the pores are easily formed in the vicinity of the protrusion vertex. Specifically, the temperature is not controlled in the same drying furnace, but can be controlled using different drying furnaces or different areas of the drying furnace in the second step and the third step. The workpiece can be moved from apparatus to apparatus or from area to area in as short a time as possible.

Namely, examples of the method of forming the surface layer in the charging member according to the present invention include a method including the following steps (1) and (2):

(1) a step of forming a coating of the coating solution for a surface layer containing the binder resin, the solvent, the electron conductive agent, and the resin particle (porous particle) as a raw material on the surface of the electro-conductive substrate or the surface of the electroconductive resin layer (electro-conductive elastic layer) formed on the electro-conductive substrate, and (2) a step of volatilizing the solvent in the coating to form the surface layer.

The step (2) is a process to volatilize the solvent in the coating, and can include the following steps (3) and (4):

(3) a step of replacing the solvent permeating through the pores in the porous particle by the binder resin, and (4) a step of drying the coating at a temperature of the boiling point or more of the solvent.

The porous particle can be a porous resin particle in which the porosity in the outer layer region is larger than that in the inner layer region and the pore diameter in the outer layer portion is larger than that in the inner layer region.

[Methods of Measuring Values of Physical Properties]

Figure 4:
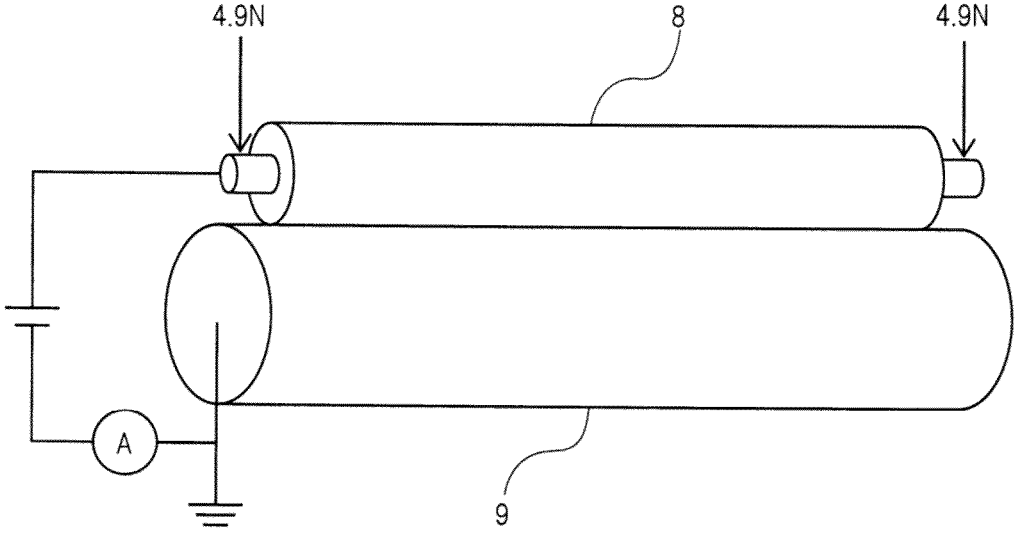
FIG. 4 is a schematic view illustrating a method of measuring an electric resistance value of the charging roller.

In FIG. 4, a method of measuring the electric resistance value of the charging roller 8 is illustrated. Loads are applied to both ends of the electro-conductive substrate in the charging roller to bring the charging roller into parallel contact with a cylindrical metal 9 having the same curvature as that of the electrophotographic photosensitive member. In this state, while the cylindrical metal is rotated by a motor (not illustrated) to rotate the charging roller contacting the cylindrical metal following the rotation of the cylindrical metal, a DC voltage of −200 V is applied from a stabilized power supply. The current flowing at this time is measured with an ammeter, and the electric resistance value of the charging roller is calculated. In the present invention, each of the loads is 500 g, and the cylindrical metal has a diameter of 30 mm and rotates at a circumferential speed of 45 mm/sec.

From the viewpoint of a uniform nip width in the longitudinal direction with respect to the electrophotographic photosensitive member, the charging roller according to the present invention can have a crown shape in which the central portion in the longitudinal direction of the charging member is the thickest and the thickness of the charging roller reduces toward the ends in the longitudinal direction. The crown amount (the average value of the differences between the outer diameter d1 of the central portion and the outer diameters d2 90 mm spaced from the central portion toward the ends) can be 30 μm or more and 200 μm or less.

The hardness of the surface of the charging member is preferably 90° or less, and more preferably 40° or more and 80° or less as a value measured with a microdurometer (MD-1 type). At a hardness within this range, the contact state of the charging member and the electrophotographic photosensitive member is easily stabilized, and discharge within the nip can be more stably performed.

The surface of the charging member preferably has a ten-point average roughness (Rzjis) of 8 μm or more and 100 μm or less, and more preferably 12 μm or more and 60 μm or less. The average interval between the concavity and the protrusion (Rsm) of the surface is 20 μm or more and 300 μm or less, and more preferably 50 μm or more and 200 μm or less. At Rzjis and Rsm within these ranges, a gap is easily formed in the nip between the charging member and the electrophotographic photosensitive member, and discharge within the nip can be stably performed.

The ten-point average roughness and the average interval between the concavity and the protrusion are measured in accordance with the specification of surface roughness specified in JIS B 0601-1994 using a surface roughness measuring apparatus "SE-3500" (trade name, made by Kosaka Laboratory Ltd.). Any six places in the charging member are measured for the ten-point average roughness, and the average value thereof is defined as the ten-point average roughness. The average interval between the concavity and the protrusion is determined as follows: ten intervals between the concavity and the protrusion is measured at the any six places to determine the average value, and the average value of the "average values at the six places" is calculated. In the measurement, a cut-off value is 0.8 mm, and an evaluation length is 8 mm.

The surface roughness (Rzjis, Rsm) of the charging member having the protrusion derived from the resin particle on the surface thereof according to the present invention is adjusted mainly according to the particle diameter of the resin particle as the raw material, the viscosity of the coating solution for forming a surface layer, the content of the resin particle in the coating solution for forming a surface layer, and the thickness of the surface layer. For example, an increase in the particle diameter of the resin particle as the raw material leads to an increase in Rzjis. An increase in the specific gravity or viscosity of the coating solution for forming a surface layer leads to a decrease in Rzjis. An increase in the thickness of the surface layer also leads to a decrease in Rzjis. Furthermore, an increase in the content of the resin particle as the raw material in the coating solution leads to a decrease in Rsm. Based on these, the factors above can be properly adjusted to obtain a charging member having a desired surface roughness.

[Evaluation of Discharge within Nip]

In the surface layer in the charging member according to the present invention, discharge within the nip is stabilized because protrusions are formed on the surface of the surface layer by the resin particle having a plurality of pores inside thereof. This is because the resin particle having a plurality of pores inside thereof properly distorts the protrusion formed of the resin particle and a gap needed for discharge is easy to keep. This distortion has an effect of reducing the slip between the charging member and the electrophotographic photosensitive member, and also contributes to stabilization of the discharge gap. Namely, use of the resin particle having a plurality of pores inside thereof can suppress the banding image and stabilize discharge within the nip at the same time.

Examples of the method of observing discharge within the nip include a method in which inside of a dark room, the charging member is brought into contact with an electro-conductive substrate formed of a transparent material; a desired voltage is applied to the charging member to generate discharge light on the electro-conductive substrate; and the discharge light is observed with a high-speed highly sensitive camera. Details of evaluation will be described later. When a charging roller is used as the charging member, the discharge light is desirably observed while the charging roller is being rotatably driven. By rotating the charging roller, the configuration for evaluation is closer to that of the real apparatus. Alternatively, the discharge light is converted into electric signals with a camera tube, and from the intensity of the light, the discharge amount can be estimated. In the present invention, the discharge amount is estimated from the discharge light using an image intensifier that can amplify faint light, and the stability of discharge within the nip is evaluated.

<Electrophotographic Process Cartridge>

Figure 6:
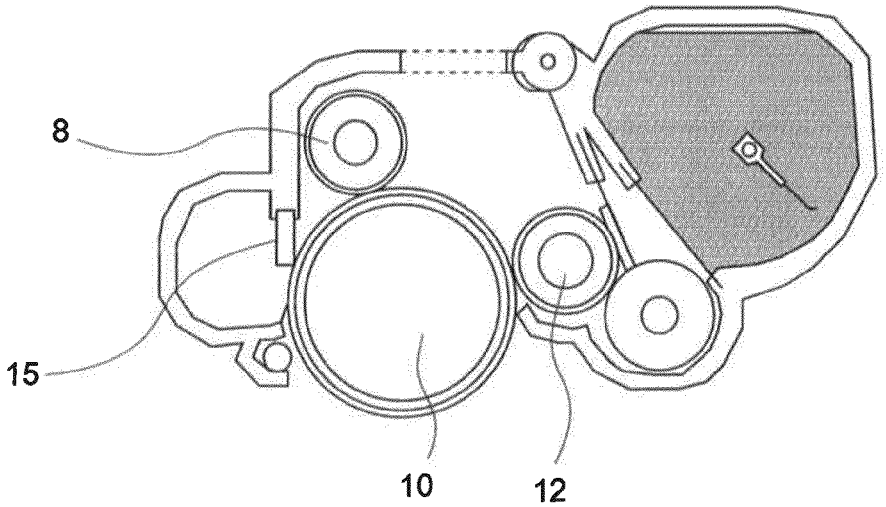
FIG. 6 is a schematic sectional view illustrating an example of an electrophotographic process cartridge according to the present invention.

The electrophotographic process cartridge according to the present invention is an electrophotographic process cartridge including the charging member and the electrophotographic photosensitive member. FIG. 6 illustrates an electrophotographic process cartridge designed to be detachably mountable to an electrophotographic apparatus and produced by integrating the electrophotographic photosensitive member, the charging apparatus, a developing apparatus, a cleaning apparatus, and the like.

<Electrophotographic Apparatus>

Figure 5:
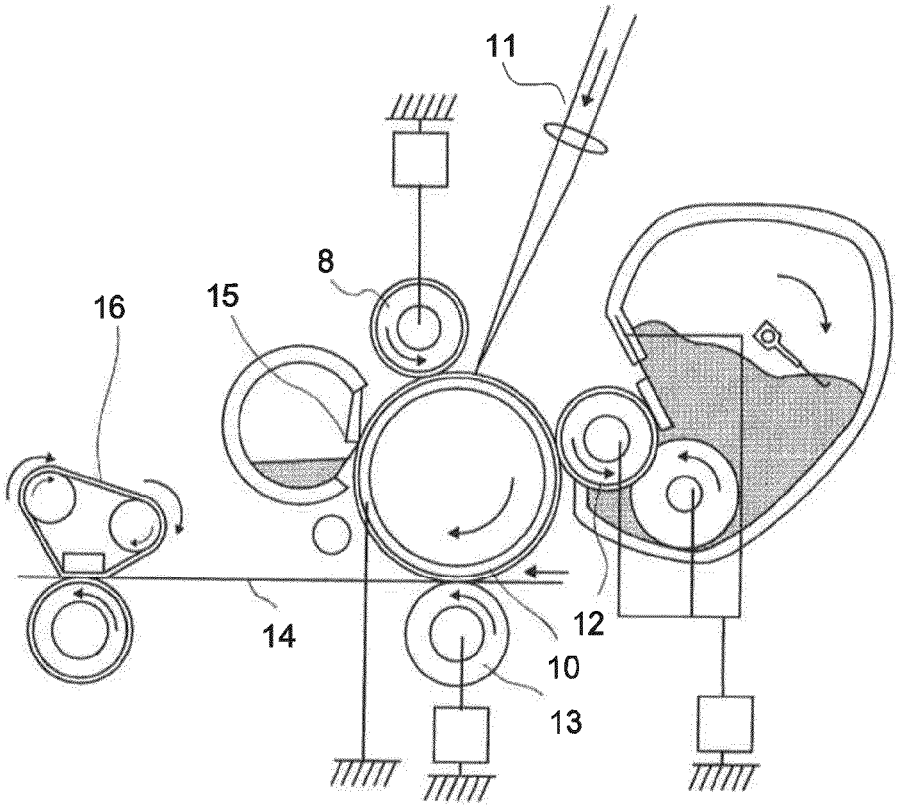
FIG. 5 is a schematic sectional view illustrating an example of an electrophotographic apparatus according to the present invention.

The electrophotographic apparatus according to the present invention is an electrophotographic apparatus on which the electrophotographic process cartridge according to the present invention is mounted. The electrophotographic apparatus illustrated in FIG. 5 includes an electrophotographic process cartridge in which an electrophotographic photosensitive member, a charging apparatus, a developing apparatus, a cleaning apparatus, and the like are integrated, a latent image forming apparatus, a developing apparatus, a transfer apparatus, and a fixing apparatus.

An electrophotographic photosensitive member 10 is a rotary drum type member having a photosensitive layer on the electro-conductive substrate. The electrophotographic photosensitive member is rotatably driven in the arrow direction at a predetermined circumferential speed (process speed). The charging apparatus includes a contact type charging roller 8 which is brought into contact with the electrophotographic photosensitive member at a predetermined pressure to be contact disposed. The charging roller rotates following the rotation of the electrophotographic photosensitive member. A predetermined DC voltage is applied from a power supply for charging to charge the electrophotographic photosensitive member to a predetermined potential.

For a latent image forming apparatus 11 for forming an electrostatic latent image on the electrophotographic photosensitive member, an exposure apparatus such as a laser beam scanner is used. An electrostatic latent image is formed by exposing a uniformly charged electrophotographic photosensitive member in correspondence with image information. The developing apparatus includes a developing roller 12 disposed close to or in contact with the electrophotographic photosensitive member. Using an electrostatically treated toner to have the same polarity as the charging polarity of the electrophotographic photosensitive member, an electrostatic latent image is developed by reversal development to form a toner image.

The transfer apparatus includes a contact type transfer roller 13. The toner image is transferred from the electrophotographic photosensitive member onto a transfer material 14 such as normal paper. The transfer material is conveyed by a sheet feeding system having a conveying member. The cleaning apparatus includes a blade type cleaning member 15 and a recovering container. After transfer, the cleaning apparatus dynamically scrapes off the transfer remaining toner left on the electrophotographic photosensitive member and recovers the toner. Here, the cleaning apparatus can be eliminated by adopting a simultaneous developing and cleaning method in which the transfer remaining toner is recovered with the developing apparatus. The fixing apparatus 16 is composed of a heated roller or the like. The fixing apparatus 16 fixes the transferred toner image on the transfer material, and discharges the transfer material to the outside of the apparatus.

EXAMPLES

Hereinafter, the present invention will be described more in details by way of specific Examples. First, prior to Examples, Production Examples A1 to A12 of the electrophotographic photosensitive member, the method of evaluating the resin particle, Production Examples B1 to B20 of the resin particle, Production Examples C1 and C2 of the fine particle, and Production Examples D1 to D20 of the charging member will be described. In the description below, "parts" mean "parts by mass".

a. Production Examples of Electrophotographic Photosensitive Member

Production Example A1

An aluminum cylinder having a diameter of 24 mm and a length of 261.6 mm was used as the support. Next, a mixed solvent of 10 parts of $SnO_2$ coated barium sulfate (conductive particle), 2 parts of titanium oxide (pigment for adjusting resistance), 6 parts of a phenol resin (binder resin), 0.001 parts of a silicone oil (leveling agent), 4 parts of methanol, and 16 parts of methoxypropanol was used to prepare a coating solution for an electrically conductive layer. The coating solution for an electrically conductive layer was applied onto the support by immersion coating, and cured (thermally cured) for 30 minutes at 140° C. to form an electrically conductive layer having a layer thickness of 15 μm on the support.

Next, 3 parts of N-methoxymethylated nylon and 3 parts of copolymerized nylon were dissolved in a mixed solvent of 65 parts of methanol and 30 parts of n-butanol to prepare a coating solution for an intermediate layer. The coating solution for an intermediate layer was applied onto the electrically conductive layer by immersion coating, and dried for 10 minutes at 80° C. to form an intermediate layer having a layer thickness of 0.7 μm on the electrically conductive layer.

Next, as the charge generating substance, 10 parts of hydroxygallium phthalocyanine crystal (charge generating substance) having strong peaks at 7.5°, 9.9°, 16.3°, 18.6°, 25.1°, and 28.3° at the Bragg angle 2θ±0.2° in CuKα properties X ray diffraction was used. The hydroxygallium phthalocyanine crystal was added to a solution prepared by dissolving 5 parts of a polyvinyl butyral resin (trade name: S-LEC BX-1, made by Sekisui Chemical Co., Ltd.) in 250 parts of cyclohexanone. The obtained solution was dispersed under a 23±3° C. atmosphere for one hour with a sand mill apparatus using glass beads having a diameter of 1 mm, and 250 parts of ethyl acetate was added to prepare a coating solution for a charge-generating layer. The coating solution for a charge-generating layer was applied onto the intermediate layer by immersion coating, and dried for 10 minutes at 100° C. to form a charge-generating layer having a layer thickness of 0.26 μm on the intermediate layer.

Next, 5.6 parts of the compound represented by the above formula (CTM-1) (charge transport substance), 2.4 parts of the compound represented by the above formula (CTM-2) (charge transport substance), 10 parts of a polycarbonate resin A(1) (resin A(1) shown in Table 1), 0.36 parts of a polycarbonate resin A'(1) (resin A'(1) shown in Table 2), and 2.5 parts of methyl benzoate were dissolved in 20 parts of dimethoxymethane and 30 parts of o-xylene to prepare a coating solution for a charge-transport layer. The coating solution for a charge-transport layer was applied onto the charge-generating layer by immersion coating, and dried at 125° C. for 30 minutes to form a charge-transport layer having a layer thickness of 15 μm on the charge-generating layer. It was found by gas chromatography that the formed charge-transport layer contained 0.028% by mass of methyl benzoate.

Thus, an electrophotographic photosensitive member A1 was produced in which the charge-transport layer was the surface layer.

Production Examples A2 to A6

Electrophotographic photosensitive members A2 to A6 were produced in the same manner as in Production Example A1 except that the kind and content of the compound (3) in Production Example A1 were changed as shown in Table 4.

Production Example A7

In formation of the charge-transport layer in Production Example A1, the drying temperature was changed to 145° C.

and the drying time was changed to 60 minutes. The mixing ratio of the solvent was changed as shown in Table 4. Except these, an electrophotographic photosensitive member A7 was produced in the same manner as in Production Example A1.

Production Examples A8 and A9

Electrophotographic photosensitive members A8 and A9 were produced in the same manner as in Production Example A1 except that the layer thickness of the charge-transport layer in Production Example A1 was changed to 30 μm in Production Example A8 and to 10 μm in Production Example A9.

Production Examples A10 and A11

Electrophotographic photosensitive members A10 and A11 were produced in the same manner as in Production Example A1 except that in formation of the charge-transport layer in Production Example A1, the drying temperature, the drying time, and the layer film thickness of the charge-transport layer were changed to 130° C., 60 minutes, and 10 μm in Production Example A10 and to 120° C., 20 minutes, and 10 μm in Production Example A11.

Production Example A12

An electrophotographic photosensitive member A12 was produced in the same manner as in Production Example A1 except that the compound (3) in Production Example A1 was not used.

Production conditions on the surface layers in Production Examples A1 to A12 and the like are shown in Table 4.

[Method of Evaluating Resin Particle]

(1-1) Measurement of the Stereoscopic Particle Shape of the Resin Particle as the Raw Material (Hollow Particle and Porous Particle)

In the hollow particle and the porous particle used as the resin particle as the raw material for the resin particle according to the present invention (hereinafter also referred to as the "resin particle as the raw material" simply), secondarily aggregated particles are removed and only primary particles are cut out by 20 nm with a focused ion beam machining observation apparatus (trade name: FB-2000C, made by Hitachi, Ltd.), and the images of the cross sections are photographed. In the same particle, the photographed images of the cross sections are combined at an interval of 20 nm, and the "stereoscopic particle shape" of the particle to be measured is calculated. This operation is performed on any 100 particles. In the image of the cross section, the resin portion is captured in grey, and the air region is captured in white. Thereby, the resin portion can be distinguished from the air region.

(1-2) Measurement of the Volume Average Particle Diameter of the Resin Particle as the Raw Material In the particle having the "stereoscopic particle shape" obtained by the method (1-1), the total volume containing the region containing air is calculated, and the diameter of a sphere having a volume equal to the total volume is determined. The average diameter of the obtained diameters of 100 spheres in total is defined as the "volume average particle diameter dv" of the resin particle.

(1-3) Measurement of the Proportion of the Region Containing Air Inside of the Resin Particle as the Raw Material From the "stereoscopic particle shape" obtained by the method (1-1), the region containing air is calculated, the proportion of the total volume of the region containing air to

TABLE 4

| | Resin (1) | | Resin (2) | | CTM | | Compound (3) | | Solvent | | Amount of compound (3) in |
|---|---|---|---|---|---|---|---|---|---|---|---|
| Production Example | Kind of resin | Parts by mass | Kind of resin | Parts by mass | Structure | Parts by mass | Kind | Parts by mass | Kind | Parts by mass | surface layer (% by mass) |
| A1 | Resin A(1) | 10 | Resin A' (1) | 0.36 | CTM-1/ CTM-2 | 5.6/2.4 | Methyl benzoate | 2.5 | o-Xylene/dimethoxymethane | 30/20 | 0.028 |
| A2 | Resin A(1) | 10 | Resin A' (1) | 0.36 | CTM-1/ CTM-2 | 5.6/2.4 | Ethyl benzoate | 2.5 | o-Xylene/dimethoxymethane | 30/20 | 0.029 |
| A3 | Resin A(1) | 10 | Resin A' (1) | 0.36 | CTM-1/ CTM-2 | 5.6/2.4 | Methyl benzoate/ethyl benzoate | 1.5/1 | o-Xylene/dimethoxymethane | 30/20 | 0.031 |
| A4 | Resin A(1) | 10 | Resin A' (1) | 0.36 | CTM-1/ CTM-2 | 5.6/2.4 | Benzyl acetate | 2.5 | o-Xylene/dimethoxymethane | 30/20 | 0.033 |
| A5 | Resin A(1) | 10 | Resin A' (1) | 0.36 | CTM-1/ CTM-2 | 5.6/2.4 | Ethyl 3-ethoxypropionate | 2.5 | o-Xylene/dimethoxymethane | 30/20 | 0.035 |
| A6 | Resin A(1) | 10 | Resin A' (1) | 0.36 | CTM-1/ CTM-2 | 5.6/2.4 | Diethylene glycol ethyl methyl ether | 2.5 | o-Xylene/dimethoxymethane | 30/20 | 0.028 |
| A7 | Resin A(1) | 10 | Resin A' (1) | 0.36 | CTM-1/ CTM-2 | 5.6/2.4 | Methyl benzoate | 2.5 | o-Xylene/dimethoxymethane | 28/20 | 0.001 |
| A8 | Resin A(1) | 10 | Resin A' (1) | 0.36 | CTM-1/ CTM-2 | 5.6/2.4 | Methyl benzoate | 2.5 | o-Xylene/dimethoxymethane | 30/20 | 0.050 |
| A9 | Resin A(1) | 10 | Resin A' (1) | 0.36 | CTM-1/ CTM-2 | 5.6/2.4 | Methyl benzoate | 2.5 | o-Xylene/dimethoxymethane | 30/20 | 0.015 |
| A10 | Resin A(1) | 10 | Resin A' (1) | 0.36 | CTM-1/ CTM-2 | 5.6/2.4 | Methyl benzoate | 2.5 | o-Xylene/dimethoxymethane | 30/20 | 0.001 |
| A11 | Resin A(1) | 10 | Resin A' (1) | 0.36 | CTM-1/ CTM-2 | 5.6/2.4 | Methyl benzoate | 2.5 | o-Xylene/dimethoxymethane | 30/20 | 0.048 |
| A12 | Resin A(1) | 10 | Resin A' (1) | 0.36 | CTM-1/ CTM-2 | 5.6/2.4 | — | — | o-Xylene/dimethoxymethane | 30/20 | — |

the total volume of the resin particle including the region containing air is calculated. The arithmetic average value of the proportions (the proportion of the total volume of region containing air to the total volume of the resin particle including the region containing air) in 100 resin particles as the raw material in total is defined as the "proportion of the region containing air in the resin particle" as the raw material.

(1-4) Measurement of the Average Diameter of the Non-Through Holes in the Resin Particle as the Raw Material (Porous Particle, Hollow Particle)

From the "stereoscopic particle shape" obtained by the method (1-1), in the region containing air, the volumes of any 10 portions not penetrating through the surface of the resin particle (non-through holes) each are calculated, and the diameters of spheres having volumes equal to the volumes are determined. This operation is performed on any 10 resin particles, and the average diameter of the obtained diameters of 100 spheres in total is calculated. This is defined as the "average diameter of non-through holes $d_H$" of the resin particle.

(1-5) Measurement of the Average Diameter of the Through Holes in the Resin Particle (Porous Particle) as the Raw Material From the "stereoscopic particle shape" obtained by the method (1-1), a sectional view is photographed in any 10 portions penetrating through the surface of the resin particle (through holes) in the region containing air. From the sectional view, the cross sectional area of the through hole is calculated, and the diameter of a circle having an area equal to the area is determined. This operation is performed on any 10 resin particles, and the average diameter of the obtained diameters of 100 circles in total is calculated. This is defined as the "average diameter $d_P$ of the through hole" of the resin particle.

(2-1) Observation of the Cross Section of the Porous Particle as the Raw Material Having a Core Shell Structure In the resin particle as the raw material having core shell structure, first, the resin particle is embedded using a photocurable resin such as visible light-curable embedding resins (trade name: D-800, made by Nisshin EM Corporation, or trade name: Epok812 Set, made by Okenshoji Co., Ltd. Next, after trimming is performed using an ultramicrotome (trade name: LEICA EM UCT, made by Leica) on which a diamond knife (trade name: DiATOMECRYO DRY, made by Diatome AG) is mounted, and a cryosystem (trade name: LEICA EM FCS, made by Leica), the center of the resin particle (to include a portion in the vicinity of the center of gravity 17 illustrated in FIG. 8) is cut out to form a section having a thickness of 100 nm. Subsequently, the embedding resin is dyed with any one of dyeing agents selected from osmium tetraoxide, ruthenium tetraoxide, and phosphorus tungstate, and a sectional image of the resin particle is photographed with a transmission electron microscope (trade name: H-7100FA, made by Hitachi, Ltd.). This operation is performed on any 100 particles. At this time, the resin portion is observed as white, and the pore portion is observed as black. The embedding resin and the dyeing agent are properly selected according to the material of the resin particle. At this time, a combination enabling the pores in the resin particle to be clearly seen is selected. For example, if the resin particle produced in Production Example B1 below is observed using a visible light-curable embedding resin D-800 and ruthenium tetraoxide, the pores into which the visible light-curable embedding resin invades can be clearly seen.

Figure 11:
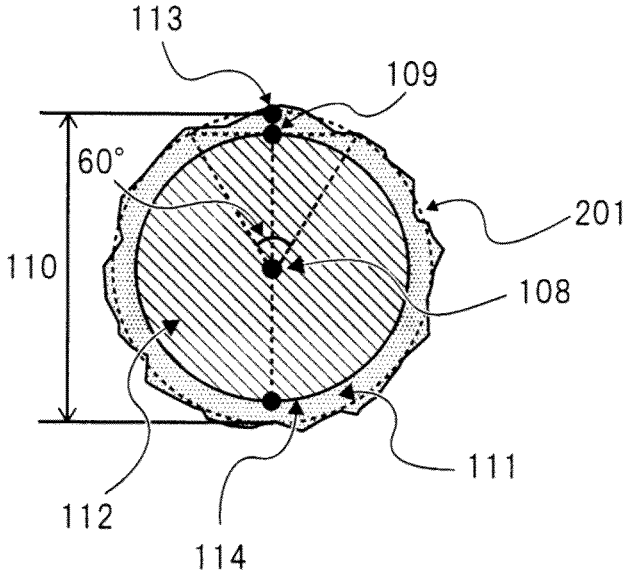
FIG. 11 is a diagram for describing a method of calculating the porosity of a resin particle.

(2-2) Porosity of the Porous Particle as the Raw Material Having a Core Shell Structure A method of calculating the porosity of the porous particle as the raw material having a core shell structure will be described in detail using FIG. 11.

A center 108 of a circle 201 having an area equal to that of the sectional image of the particle obtained in (2-1) above is calculated. The circle is superposed on the sectional image such that the center 108 matches with the center of gravity 17 of the resin particle. A point obtained by equally dividing the outer periphery of a circle 201 (such as 113) by 100 is calculated. A line connecting the point on the circumference to the center of gravity of the resin particle is drawn. A position shifted by a distance of $\sqrt{3/4}$ times length of the particle diameter 110 from the center 108 of the circle to the outside of the particle such as the direction from 108 to 113 (such as 109) is calculated. The calculation is performed in all the points on the circumference obtained by dividing the outer periphery of the circle 201 (113-1, 113-2, 113-3, . . . ) by 100, and 100 points corresponding to the position 109 (109-1, 109-2, 109-3, . . . ) are determined. A region 112 on the center 108 side in the region obtained by connecting these 100 points by straight lines is defined as the inner layer region in the resin particle, and a region on the outer side 111 is defined as the outer layer region in the resin particle.

In the inner layer region and the outer layer region in the resin particle, the proportion of the total area of the pore portion to the total area including the region containing the pore portion is calculated in the sectional image. The average is defined as the porosity.

(2-3) Pore Diameter of the Porous Particle as the Raw Material Having a Core Shell Structure In the inner layer region and the outer layer region in the resin particle, 10 pore portions seen in black are selected at random, and the areas of the 10 pore portions are measured. The arithmetic average value of the diameters of circles having areas equal to the areas is defined as the pore diameter of the porous particle having a core shell structure.

(3) Measurement of the "stereoscopic particle shape" of the resin particle contained in the surface layer Any protrusion in the surface of the charging member is cut out over a region having a length of 200 μm and a width of 200 μm parallel to the surface of the charging member by 20 nm from the protrusion vertex side of the charging member using a focused ion beam machining observation apparatus (trade name: FB-2000C, made by Hitachi, Ltd.), and the images of the cross sections are photographed. The images obtained by photographing the same particle are combined at an interval of 20 nm, and the "stereoscopic particle shape" is calculated. This operation is performed on any 100 places in the surface of the charging member.

(4) Measurement of the Volume Average Particle Diameter of the Resin Particle Contained in the Surface Layer In the "stereoscopic particle shape" obtained by the method described in (3), the total volume including the region containing the pores is calculated. This is the volume of the resin particle assuming that the resin particle is a solid particle. Then, the diameter of a sphere having a volume equal to the volume is determined. The average diameter of the obtained diameters of 100 spheres in total is calculated, and defined as the "volume average particle diameter dv" of the resin particle.

Figure 7:
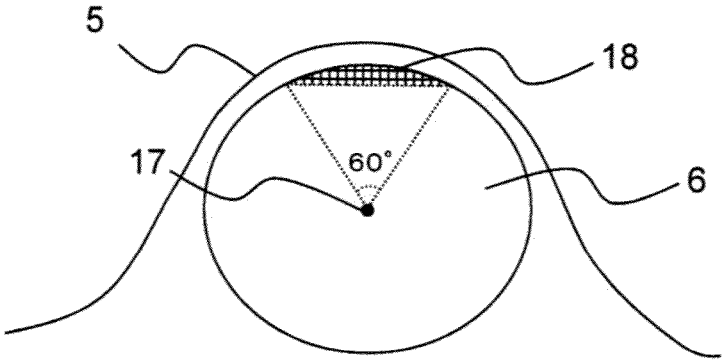
FIG. 7 is a sectional view illustrating a resin particle that forms a protrusion in the surface layer formed in the charging member.
Figure 8:
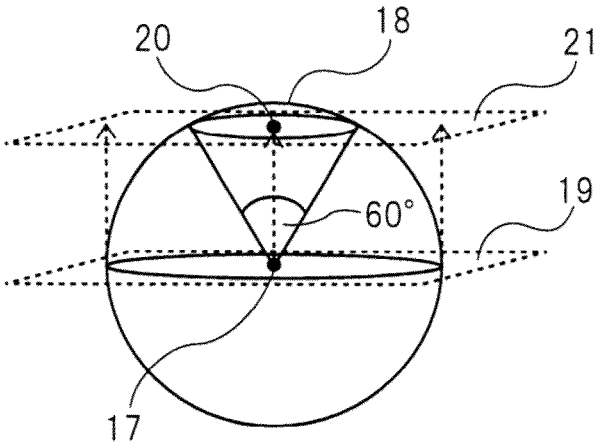
FIG. 8 is a stereoscopic schematic view of the resin particle that forms a protrusion in the surface layer formed in the charging member.

(5) Measurement of the Porosity of the Resin Particle Contained in the Surface Layer From the "stereoscopic particle shape" obtained by the method described in (3), the "vertex side region of protrusion" of the solid particle is calculated assuming that the resin particle is the solid particle. FIG. 7 is a sectional view of the resin particle that forms of the protrusion in the surface of the charging member, and FIG. 8 is a stereoscopic schematic view thereof. The method of calculating the porosity will be described below using these drawings. First, from the "stereoscopic particle shape", the center of gravity 17 of the resin particle is calculated. A virtual plane 19 being parallel to the surface of the charging member and passing through the center of gravity of the resin particle is created. The virtual plane is translated by a distance of $\sqrt{3}/2$ times length of the radius r of the sphere from the center of gravity of the resin particle to a position 20 on the protrusion vertex side. That is, the center of gravity 17 is translated to the position of the virtual plane 21. The region on the protrusion vertex side surrounded by the virtual plane 21 and the surface of the resin particle is defined as the "vertex side region of protrusion" of the solid particle when it is assumed that the resin particle is the solid particle. In the region, from the "stereoscopic particle shape", the total volume of the pore is calculated, and the proportion thereof to the total volume of the region including the pores is calculated. This is defined as the porosity of the "vertex side region of protrusion" (hereinafter also referred to as a "porosity B".

From the "stereoscopic particle shape", the total volume of the pore in the entire resin particle is calculated, and the proportion thereof to the total volume of the resin particle including the region containing the pores is calculated. This is defined as the porosity of the entire resin particle (hereinafter also referred to as a "porosity A").

(6) Measurement of the Pore Diameter of the Resin Particle Contained in the Surface Layer In the "vertex side region of protrusion" of the solid particle when it is assumed that the resin particle is the solid particle, from the "stereoscopic particle shape" obtained above, the largest length and the smallest length of a pore portion are measured in 10 pore portions, and the average value of the largest lengths and that of the smallest lengths are calculated. This operation is performed on any 10 resin particles. The average value of the 100 measurement values obtained in total is calculated, and defined as the pore diameter in the "vertex side region of protrusion" in the resin particle.

B. Production Examples of Resin Particle as Raw Material

Production Example B1

Eight parts by mass of tricalcium phosphate was added to 400 parts by mass of deionized water to prepare an aqueous medium. Next, 20 parts by mass of methyl methacrylate, 10 parts by mass of 1,6-hexanediol dimethacrylate, 75 parts by mass of n-hexane, and 0.3 parts by mass of benzoyl peroxide were mixed to prepare an oily mixed solution. The oily mixed solution was dispersed in the aqueous medium at the number of rotation of 3000 rpm with a homomixer. Subsequently, the obtained solution was charged into a polymerization reaction container whose inside was replaced by nitrogen. While the solution was being stirred at 250 rpm, suspension polymerization was performed at 60° C. over 6 hours. Thus, an aqueous suspension containing the porous particle and n-hexane was obtained. To the aqueous suspension, 0.4 parts by mass of sodium dodecylbenzenesulfonate was added, and the concentration of sodium dodecylbenzenesulfonate was adjusted to be 0.1% by mass based on water.

The obtained aqueous suspension was distilled to remove n-hexane, and the remaining aqueous suspension was repeatedly filtered and washed with water. Then, drying was performed at 80° C. for 5 hours. The product was crushed and classified with a sonic classifier to obtain a resin particle B1 having a volume average particle diameter dv of 30.5 μm. The resin particle was observed by the embedding method above. Then, it was found that the resin particle B1 was a porous particle having a number of micropores penetrating through the surface inside of the resin particle.

Production Examples B2 to B4

Resin particles B2 to B4 were obtained in the same manner as in Production Example B1 except that the number of rotation of the homomixer was changed to 4500 rpm, 5000 rpm, and 2500 rpm, respectively. Each of the resin particles was the porous particle similar to the resin particle B1.

Production Example B5

To 300 parts by mass of deionized water, 10.5 parts by mass of tricalcium phosphate and 0.015 parts by mass of sodium dodecylbenzenesulfonate were added to prepare an aqueous medium. Next, 65 parts by mass of lauryl methacrylate, 30 parts by mass of ethylene glycol dimethacrylate, 5 parts by mass of poly(ethylene glycol-tetramethylene glycol) monomethacrylate, and 0.5 parts by mass of azobisisobutyronitrile were mixed to prepare an oily mixed solution. The oily mixed solution was dispersed in the aqueous medium at the number of rotation of 4000 rpm with a homomixer. Subsequently, the obtained solution was charged into a polymerization reaction container whose inside was replaced by nitrogen. While the solution was being stirred at 250 rpm, suspension polymerization was performed at 70° C. over 8 hours. After cooling, hydrochloric acid was added to the obtained suspension to decompose calcium phosphate. Further, filtration and washing with water were repeated. After drying at 80° C. for 5 hours, product was crushed and classified with a sonic classifier to obtain a resin particle B5 having a volume average particle diameter dv of 35.2 μm. The resin particle was observed by the embedding method above. Then, it was found that the resin particle B5 was a hollow particle having only a plurality of hollow portions (non-through holes) inside of the particle. The average diameter of the non-through holes $d_H$ was 3.5 μm.

Production Examples B6, B10, B12, and B13

Resin particles B6, B10, B12, and B13 were obtained in the same manner as in Production Example B5 except that the number of rotation of the homomixer was changed to 3500 rpm, 2700 rpm, 3000 rpm, and 2500 rpm, respectively. Each of the resin particles was the hollow particle similar to the resin particle B5.

Production Example B7

Eight parts by mass of polyvinyl alcohol (saponification degree: 85%) was added to 400 parts by mass of deionized water to prepare an aqueous medium. Next, 6.5 parts by mass of methyl methacrylate, 6.5 parts by mass of styrene, 9 parts by mass of divinylbenzene, 85 parts by mass of n-hexane, and 0.3 parts by mass of lauroyl peroxide were mixed to prepare an oily mixed solution. The oily mixed solution was dispersed in the aqueous medium at the number of rotation of 2000 rpm with a homomixer. Subsequently, the obtained solution was charged into a polymerization reaction container whose inside was replaced by nitrogen. While the solution was being stirred at 250 rpm, suspension polymerization was performed at 60° C. over 6 hours. Thus, an aqueous suspension containing a porous particle and n-hexane was obtained. Subsequently, a resin particle B7 was obtained in the same manner as in Production Example B1. The resin particle was the porous particle similar to the resin particle B1.

Production Example B8

A resin particle B8 was obtained in the same manner as in Production Example B7 except that the number of rotation of the homomixer was changed to 1800 rpm. The resin particle was the porous particle similar to the resin particle B1.

Production Example B9

Eight parts by mass of tricalcium phosphate was added to 400 parts by mass of deionized water to prepare an aqueous medium. Next, 33 parts by mass of methyl methacrylate, 17 parts by mass of 1,6-hexanediol dimethacrylate, 50 parts by mass of n-hexane, and 0.3 parts by mass of benzoyl peroxide were mixed to prepare an oily mixed solution. The oily mixed solution was dispersed in the aqueous medium at the number of rotation of 4800 rpm with a homomixer. Subsequently, the obtained solution was charged into a polymerization reaction container whose inside was replaced by nitrogen. While the solution was being stirred at 250 rpm, suspension polymerization was performed at 60° C. over 6 hours. Thus, an aqueous suspension containing a porous particle and n-hexane was obtained. To the aqueous suspension, 0.2 parts by mass of sodium lauryl sulfate was added, and the concentration of sodium lauryl sulfate was adjusted to be 0.05% by mass based on water. Subsequently, a resin particle B9 was obtained in the same manner as in Production Example B1. The resin particle was the porous particle similar to the resin particle B1.

Production Examples B15 to B17

A crosslinked polymethyl methacrylate resin particle (trade name: MBX-30, made by SEKISUI PLASTICS CO., Ltd.) was classified to obtain a resin particle B15 having a volume average particle diameter of 18.2 μm and a resin particle B16 having a volume average particle diameter of 12.5 μm. A non-classified MBX-30 was used as a resin particle B17. The resin particles in these Production Examples had no pores inside thereof.

Production Example B11

A resin particle B11 was obtained in the same manner as in Production Example B8 except that the number of rotation of the homomixer was changed to 1500 rpm. The resin particle was the porous particle similar to the resin particle B1.

Production Example B14

A resin particle B14 was obtained in the same manner as in Production Example B9 except that the number of rotation of the homomixer was changed to 5000 rpm. The resin particle was the porous particle similar to the resin particle B1.

Production Example B18

To 400 parts by mass of deionized water, 8.0 parts by mass of tricalcium phosphate was added to prepare an aqueous medium. Next, 38.0 parts by mass of methyl methacrylate as a polymerizable monomer, 26.0 parts by mass of ethylene glycol dimethacrylate as a crosslinkable monomer, 34.1 parts by mass of normal hexane as a first porosifying agent, 8.5 parts by mass of ethyl acetate as a second porosifying agent, and 0.3 parts by mass of 2,2'-azobisisobutyronitrile were mixed to prepare an oily mixed solution. The oily mixed solution was dispersed in the aqueous medium at the number of rotation of 2000 rpm with a homomixer. Subsequently, the obtained solution was charged into a polymerization reaction container whose inside was replaced by nitrogen. While the solution was being stirred at 250 rpm, suspension polymerization was performed at 60° C. over 6 hours. Thus, an aqueous suspension containing a porous resin particle, normal hexane, and ethyl acetate was obtained. To the aqueous suspension, 0.4 parts by mass of sodium dodecylbenzenesulfonate was added, and the concentration of sodium dodecylbenzenesulfonate was adjusted to be 0.1% by mass based on water.

The obtained aqueous suspension was distilled to remove normal hexane and ethyl acetate, and the remaining aqueous suspension was repeatedly filtered and washed with water. Then, drying was performed at 80° C. for 5 hours. The product was crushed and classified with a sonic classifier to obtain a resin particle B18 having a volume average particle diameter dv of 30.5 μm. The cross section of the particle was observed by the method above. Then, it was found that the resin particle B18 was a porous particle having pores having a diameter of approximately 21 nm in the inner layer region in the resin particle and pores having a diameter of approximately 87 nm in the outer layer region.

Production Examples B19 and B20

Resin particles B19 and B20 were obtained in the same manner as in Production Example B18 except that in the oily mixed solution, the polymerizable monomer, the crosslinkable monomer, the first porosifying agent, and the second porosifying agent were changed as shown in Table 5, and the number of rotation of the homomixer was changed as shown in Table 5. The obtained resin particle was a porous particle.

TABLE 5

| Production Example | Polymerizable monomer | Parts by mass | Crosslinkable monomer | Parts by mass | First porosifying agent | Parts by mass | Second porosifying agent | Parts by mass | Number of rotation of homomixer (ppm) |
|---|---|---|---|---|---|---|---|---|---|
| B18 | Methyl methacrylate | 38.0 | Ethylene glycol dimethacrylate | 26.0 | Normal hexane | 34.1 | Ethyl acetate | 8.5 | 2000 |
| B19 | Methyl methacrylate | 32.0 | Ethylene glycol dimethacrylate | 21.9 | Normal hexane | 43.1 | Ethyl acetate | 10.8 | 3600 |

TABLE 5-continued

| Production Example | Polymerizable monomer | Parts by mass | Crosslinkable monomer | Parts by mass | First porosifying agent | Parts by mass | Second porosifying agent | Parts by mass | Number of rotation of homomixer (ppm) |
|---|---|---|---|---|---|---|---|---|---|
| B20 | Butyl methacrylate | 38.0 | Ethylene glycol dimethacrylate | 26.0 | Normal hexane | 34.1 | Isopropyl acetate | 8.5 | 1400 |

(Evaluation of Properties of Resin Particle)

In the resin particles B1 to B17 obtained Production Examples above, the volume average particle diameter dv, the shape of the particle, the average diameter of the non-through holes $d_H$, the number of non-through holes (plural or not), the average diameter $d_P$ of the through hole, and the proportion of the region containing air in the particle were measured. The results are shown in Table 6.

TABLE 6

| Kind of resin particles | Volume average particle diameter (μm) | Shape of particle | Average diameter of non-through hole (μm) | Number of non-through holes | Average diameter of through hole (nm) | Proportion of region containing air in resin particle (%) |
|---|---|---|---|---|---|---|
| B1 | 30.5 | Porous | 0.092 | Plural | 20 | 28 |
| B2 | 20.2 | Porous | 0.085 | Plural | 50 | 21 |
| B3 | 18.3 | Porous | 0.11 | Plural | 31 | 19 |
| B4 | 35.3 | Porous | 0.12 | Plural | 21 | 32 |
| B5 | 35.2 | Hollow | 3.5 | Plural | — | 25 |
| B6 | 41.0 | Hollow | 4.2 | Plural | — | 28 |
| B7 | 49.0 | Porous | 0.081 | Plural | 21 | 29 |
| B8 | 51.0 | Porous | 0.15 | Plural | 32 | 31 |
| B9 | 10.5 | Porous | 0.12 | Plural | 25 | 20 |
| B10 | 50.2 | Hollow | 4.5 | Plural | — | 31 |
| B11 | 60.0 | Porous | 0.15 | Plural | 21 | 32 |
| B12 | 45.2 | Hollow | 4.0 | Plural | — | 35 |
| B13 | 62.0 | Hollow | 3.5 | Plural | — | 29 |
| B14 | 8.4 | Porous | 0.11 | Plural | 32 | 34 |
| B15 | 18.2 | Solid | — | — | — | 0 |
| B16 | 12.5 | Solid | — | — | — | 0 |
| B17 | 30.0 | Solid | — | — | — | 0 |

In the resin particles B18 to B20 obtained in Production Examples above, the volume average particle diameter dv, the porosity in the inner layer region and the outer layer region, and the pore diameter in the inner layer region and the outer layer region were measured. The results are shown in Table 7.

TABLE 7

| Kind of resin particles | Shape of particle | Volume average particle diameter (μm) | Inner layer region | | Outer layer region | | Outer layer portion/inner layer portion | |
|---|---|---|---|---|---|---|---|---|
| | | | Pore diameter (nm) | Porosity (%) | Pore diameter (nm) | Porosity (%) | Pore ratio (nm) | Pore ratio (%) |
| B18 | Porous particle | 30.5 | 21 | 20 | 87 | 35 | 4.1 | 1.8 |
| B19 | Porous particle | 20.2 | 22 | 21 | 90 | 42 | 4.1 | 2.0 |
| B20 | Porous particle | 35.3 | 15 | 15 | 55 | 32 | 3.7 | 2.1 |

C. Production Examples of Conductive Particle and Insulation Particle

Production Example C1

140 g of methyl hydrogen polysiloxane was added to 7.0 kg of a silica particle (average particle diameter: 15 nm, volume resistivity: $1.8\times10^{12}$ Ω·cm) while an edge runner was operated, and mixed and stirred at a line load of 588 N/cm (60 kg/cm) for 30 minutes. At this time, the stirring rate was 22 rpm. 7.0 kg of carbon black "#52" (trade name, made by Mitsubishi Chemical Corporation) was added to the mixture over 10 minutes while the edge runner was operated, and further mixed and stirred at a line load of 588 N/cm (60 kg/cm) over 60 minutes. Thus, carbon black was adhered to the surface of the silica particle coated with methyl hydrogen polysiloxane. Then, drying was performed at 80° C. for 60 minutes with a dryer to prepare a composite conductive fine particle C1. At this time, the stirring rate was 22 rpm. The obtained composite conductive fine particle had an average primary particle diameter of 15 nm and a volume resistivity of $1.1\times10^{2}$ Ω·cm.

Production Example C2

110 g of isobutyltrimethoxysilane as a surface treatment agent and 3000 g of toluene as a solvent were blended with 1000 g of a needle-like rutile titanium oxide particle (average particle diameter: 15 nm, length:width=3:1, volume resistivity: $2.3\times10^{10}$ Ω·cm) to prepare a slurry. After the slurry was mixed with a stirrer for 30 minutes, the slurry was fed to a Visco Mill having glass beads having an average particle size of 0.8 mm filled up to 80% of the effective inner volume. Then, the slurry was wet crushed at a temperature of 35±5° C. Using a kneader, toluene was removed from the slurry obtained by the wet crushing by reduced pressure distillation (bath temperature: 110° C., product temperature: 30 to 60° C., reduced pressure degree: approximately 100 Torr). Then, a surface treatment agent was baked to the slurry at 120° C. for 2 hours. The baked particle was cooled to room temperature, and then ground using a pin mill to produce a surface treated titanium oxide particle C2. The surface treated titanium oxide particle (insulation particle) obtained had an average primary particle diameter of 15 nm and a volume resistivity of $5.2\times10^{15}$ Ω·cm.

D. Production Examples of Charging Member

Production Example D1

(1. Preparation of Electro-Conductive Substrate)

A thermosetting adhesive containing 10% by mass of carbon black was applied to a stainless steel substrate having a diameter of 6 mm and a length of 244 mm, and dried. The obtained product was used as the electro-conductive substrate.

(2. Preparation of Conductive Rubber Composition)

Seven other materials shown in Table 8 below were added to 100 parts by mass of an epichlorohydrin rubber (EO-EP-AGE ternary copolymer, EO/EP/AGE=73 mol %/23 mol %/4 mol %), and kneaded for 10 minutes with a sealed type mixer adjusted at 50° C. to prepare a raw material compound.

TABLE 8

| Material | Amount in use (parts by mass) |
|---|---|
| Epichlorohydrin rubber (EO-EP-AGE ternary copolymer, EO/EP/AGE = 73 mol %/23 mol %/4 mol %) | 100 |
| Calcium carbonate (trade name: Silver-W, made by Shiraishi Kogyo Kaisha, Ltd.) | 80 |
| Adipic acid ester (trade name: POLYCIZER W305ELS, made by DIC Corporation) | 8 |
| Zinc stearate (trade name: SZ-2000, made by Sakai Chemical Industry Co., Ltd.) | 1 |
| 2-Mercaptobenzimidazole (MB) (antioxidant) | 0.5 |
| Zinc oxide (trade name: two zinc oxides, made by Sakai Chemical Industry Co., Ltd.) | 2 |
| Quaternary ammonium salt "ADK CIZER LV-70" (trade name, made by ADEKA Corporation) | 2 |
| Carbon black "Thermax Floform N990" (trade name, made by Cancarb Ltd., Canada, average particle diameter: 270 nm) | 5 |

EO: Ethylene oxide,
EP: Epichlorohydrin,
AGE: Allyl glycidyl ether 0.8 Parts by mass of sulfur as a vulcanizing agent and 1 part by mass of dibenzothiazyl sulfide (DM) and 0.5 parts by mass of tetramethyl thiuram monosulfide (TS) as vulcanization accelerators were added to the raw material compound. Next, the mixture was kneaded for 10 minutes with a two-roll mill whose temperature was cooled to 20° C. to prepare a conductive rubber composition. At this time, the interval of the two-roll mill was adjusted to be 1.5 mm.

(3. Preparation of Elastic Roller)

Using an extrusion molding apparatus including a cross-head, the electro-conductive substrate was used as the center shaft, and its outer periphery was coaxially coated with the conductive rubber composition to obtain a rubber roller. The thickness of the coating rubber composition was adjusted to be 1.75 mm.

After the rubber roller was heated at 160° C. for one hour in a hot air furnace, ends of the electro-conductive elastic layer were removed such that the length was 226 mm. Furthermore, the roller was secondarily heated at 160° C. for one hour to produce a roller including a preparative coating layer having a layer thickness of 1.75 mm.

The outer peripheral surface of the produced roller was polished using a plunge cutting mode cylinder polisher. A vitrified grinding wheel was used as the polishing grinding wheel. The abrasive grain was green silicon carbide (GC), and the grain size was 100 mesh. The number of rotation of the roller was 350 rpm, and the number of rotation of the polishing grinding wheel was 2050 rpm. The rotational direction of the roller was the same as the rotational direction of the polishing grinding wheel (following direction). The cutting speed was changed stepwise from 10 mm/min to 0.1 mm/min from a time when the grinding wheel is brought into contact with the unpolished roller to a time when the roller was polished to 09 mm. The spark-out time (time at a cutting amount of 0 mm) was set 5 seconds. Thus, an electro-conductive elastic roller was prepared. The thickness of the elastic layer was adjusted to be 1.5 mm. The crown amount of the roller was 100 μm.

(4. Preparation of Coating Solution for Forming Surface Layer)

Methyl isobutyl ketone was added to a caprolactone-modified acrylic polyol solution "Placcel DC2016" (trade name, made by Daicel Corporation), and the solid content was adjusted to be 12% by mass. Four other materials shown in Component (1) in Table 9 below were added to 834 parts by mass of the solution (solid content of caprolactone-modified acrylic polyol: 100 parts by mass) to prepare a mixed solution. At this time, the block isocyanate mixture had an amount of isocyanate at "NCO/OH=1.0".

Next, 188.5 g of the mixed solution was placed in a glass bottle having an inner volume of 450 mL, with 200 g of glass beads as a medium having an average particle diameter of 0.8 mm. Using a paint shaker dispersing machine, the mixed solution was dispersed for 20 hours. After dispersion, 7.2 g of the resin particle B1 was added. This is equivalent to 40 parts by mass of the resin particle B1 based on 100 parts by mass of solid content of the caprolactone-modified acrylic polyol. Subsequently, the resin particle B1 was dispersed for 5 minutes, and the glass beads were removed to prepare a coating solution for a surface layer. The specific gravity of the coating solution was 0.9260. The specific gravity was measured by putting a commercially available densimeter into the coating solution.

TABLE 9

| | Material | Amount in use (parts by mass) |
|---|---|---|
| Component (1) | Caprolactone-modified acrylic polyol solution (trade name: Placcel DC2016, made by Daicel Corporation) | 100 |
| | Composite conductive fine particle (produced in Production Example C1) | 60 |
| | Surface treated titanium oxide particle (produced in Production Example C2) | 50 |
| | Modified dimethylsilicone oil (trade name: SH28PA, made by Dow Corning Toray Co., Ltd.) | 0.08 |
| | Block isocyanate mixture (7:3 mixture of butanone oxime block of hexamethylene diisocyanate (HDI) and that of isophorone diisocyanate (IPDI)) | 80.14 |
| Resin particle | Resin particle B1 | 40 |

(5. Formation of Surface Layer)

The elastic roller was directed in the longitudinal direction, vertically immersed in the coating solution for a surface layer, and coated by dipping. The immersion time was 9 seconds. As the take-up rate, the initial rate was 20 mm/s, and the final rate was 2 mm/s. In-between, the take-up rate was linearly changed with respect to time. The obtained coated product was air dried at 23° C. for 30 minutes, then dried at a temperature of 80° C. for one hour with a hot air circulation dryer, and further dried at a temperature of 160° C. for one hour to cure the coating. Thus, a charging roller D1 having a surface layer in the outer peripheral portion of the elastic layer was obtained. The layer thickness of the surface layer was 5.6 μm. The layer thickness of the surface layer was measured in a portion wherein no resin particle exists.

Production Examples D2 to D20

Charging rollers D2 to D20 were produced by the same method as that in Production Example D1 except that the materials shown in Tables 10 and 11 below were used. The values of the physical properties of the finished charging roller and those of the resin particle contained in the surface layer of the charging roller are shown in Table 10 and Table 11. The surface roughness (Rzjis and Rsm) of each of the charging rollers was measured by the method above.

TABLE 10

| Production Example No. | Resin particle: Resin particle | Resin particle: Volume average particle diameter (μm) | Resin particle: Shape of particle | Resin particle: Porosity A (%) | Electric resistance Ω × $10^5$ | Specific gravity of coating solution for surface layer | Layer thickness of surface layer (μm) | Surface roughness: Rzjis (μm) | Surface roughness: Rsm (μm ) |
|---|---|---|---|---|---|---|---|---|---|
| D1 | B1 | 29.9 | Porous | 0.91 | 5.6 | 0.926 | 5.6 | 32.1 | 108 |
| D2 | B2 | 20.0 | Porous | 1.2 | 4.8 | 0.925 | 5.3 | 22.6 | 80 |
| D3 | B3 | 18.2 | Porous | 0.72 | 3.6 | 0.927 | 5.8 | 20.8 | 74 |
| D4 | B4 | 35.3 | Porous | 0.61 | 2.8 | 0.930 | 6.2 | 36.5 | 122 |
| D5 | B5 | 35.2 | Hollow | 25 | 7.5 | 0.919 | 4.8 | 33.9 | 93 |
| D6 | B6 | 40.5 | Hollow | 30 | 8.3 | 0.925 | 4.6 | 38.9 | 105 |
| D7 | B7 | 47.5 | Porous | 1.2 | 5.1 | 0.930 | 5.5 | 49.1 | 160 |
| D8 | B8 | 49.3 | Porous | 1.1 | 6.4 | 0.930 | 5.2 | 50.9 | 166 |
| D9 | B9 | 10.0 | Porous | 0.76 | 7.2 | 0.918 | 4.2 | 13.7 | 52 |
| D10 | B10 | 49.9 | Hollow | 33 | 3.9 | 0.950 | 5.2 | 46.7 | 123 |
| D11 | B11 | 59.2 | Porous | 0.95 | 4.8 | 0.953 | 5.3 | 59.2 | 191 |
| D12 | B12 | 45.0 | Hollow | 37 | 2.6 | 0.913 | 3.5 | 42.4 | 113 |
| D13 | B13 | 61.8 | Hollow | 29 | 5.3 | 0.918 | 4.1 | 56.7 | 147 |
| D14 | B14 | 8.0 | Porous | 0.68 | 4.8 | 0.910 | 2.4 | 12.7 | 52 |
| D15 | B15 | 18.2 | Solid | 0 | 6.5 | 0.973 | 16.3 | 15.7 | 49 |
| D16 | B16 | 11.8 | Solid | 0 | 9.1 | 0.973 | 16.5 | 11.8 | 42 |
| D17 | B17 | 29.6 | Solid | 0 | 1.9 | 0.910 | 2.4 | 24.0 | 49 |

TABLE 11

| Production Example No. | Resin particle | Volume average particle diameter (μm) | Porosity (%) A | Porosity (%) B | Pore diameter (nm) Vertex side region of protrusion | Electric resistance Ω × $10^5$ | Specific gravity of coating solution for surface layer | Layer thickness of surface layer (μm) | Surface roughness: Rzjis (μm) | Surface roughness: Rsm (μm) |
|---|---|---|---|---|---|---|---|---|---|---|
| D18 | B18 | 29.9 | 0.91 | 6 | 131 | 5.0 | 0.9110 | 4.9 | 31.5 | 108 |
| D19 | B19 | 20.1 | 1.2 | 9 | 135 | 4.3 | 0.9110 | 5.0 | 22.2 | 80 |
| D20 | B20 | 32.3 | 0.72 | 5.5 | 83 | 5.3 | 0.9110 | 5.1 | 35.7 | 122 |

Example 1

1. Evaluation of Situation of Banding Image Produced (Evaluation A)

The charging roller D18 and the electrophotographic photosensitive member A1 were integrated into an electrophotographic apparatus, and a durability test was performed under a low temperature and low humidity environment (temperature: 15° C., relative humidity: 10%). As the electrophotographic apparatus, a color laser jet printer (trade name: Satera LBP5400) made by Canon Inc. was modified to have an output speed of a recording medium of 200 mm/sec (A4 vertically output), and used. The spring used as a bearing for the charging roller was modified such that the charging roller contacted the electrophotographic photosensitive member at a pressure of 2.9 N at one end and 5.9 N at both ends. Thus, if the contact pressure is reduced, a situation in which the banding image is easily produced can be created. The resolution of an image was 600 dpi, and an output of primary charge was a DC voltage of −1100 V. As the electrophotographic process cartridge, an electrophotographic process cartridge for the printer was used. An output image was a halftone image in which a horizontal line at a width of one dot and an interval of two dots was drawn in the direction perpendicular to the rotational direction of the electrophotographic photosensitive member. The output halftone image was visually observed whether streaks extending in the rotational direction of the electrophotographic photosensitive member, namely, in the direction perpendicular to the paper discharging direction appeared in synchronization with the rotational cycle of the charging roller. The results were evaluated on the following criteria. The results of evaluation are shown in Table 12.

Rank 1; no streaks are found.

Rank 2; streaks are slightly found.

Rank 3; streaks are remarkably found.

2. Evaluation of Discharge Intensity within the Nip (Evaluation B)

Figure 9:
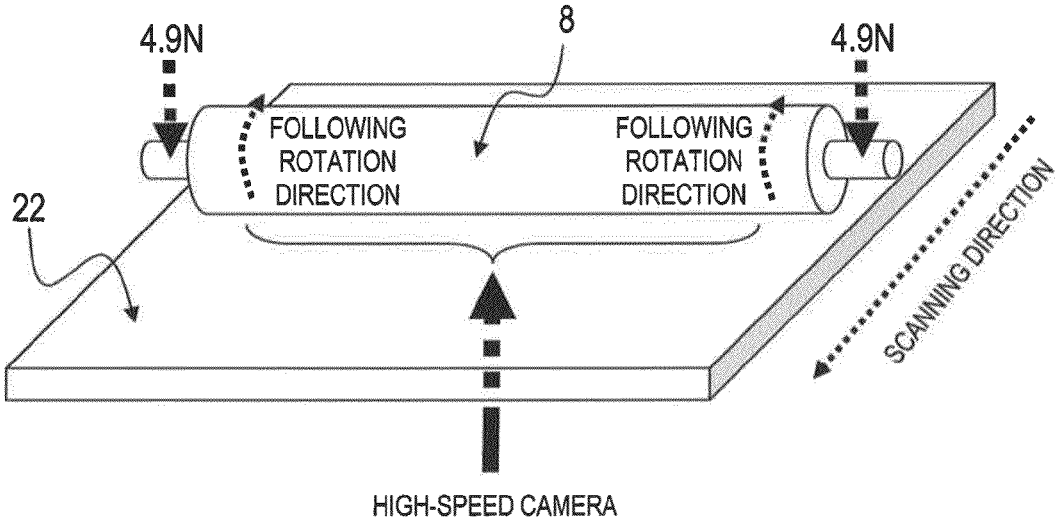
FIG. 9 is a schematic view illustrating an apparatus used in observation of discharge in a nip formed by the charging roller.

A 5 μm ITO film was formed on the surface of a glass plate (length: 300 mm, width: 240 mm, thickness: 4.5 mm), and further a 17 μm charge-transport layer alone was formed thereon. As illustrated in FIG. 9, a tool enabling a charging roller 8 to contact the surface of a glass plate 22 after film formation at a pressure of 4.9 N in one end and 9.8 N in total in both ends by press of the spring was produced. Further, the tool could scan the glass plate 22 at 200 mm/s. Using the glass plate 22 as the electrophotographic photosensitive member, a photograph was taken from under the contact region (the side opposite to the front surface of the glass plate 22) via a high-speed gate I.I. unit C9527-2 (product name, made by Hamamatsu Photonics K.K.) with a high-speed camera FASTCAM-SA1.1 (product name, made by Hamamatsu Photonics K.K.). The voltage to be applied to the charging roller 8 was a superimposed voltage of AC and DC. The AC voltage had a peak to peak voltage (Vpp) of 1400 V and a frequency (f) of 1350 Hz, and the DC voltage (Vdc) was −560 V. The environment for measurement was a low temperature and low humidity environment (temperature: 15° C., relative humidity: 10%).

For the photographing conditions, the photographing rate was 3000 fps, and the photographing time was approximately 0.3 seconds. In photographing, sensitivity was properly adjusted, the brightness of the image to be taken was adjusted. The obtained moving picture was averaged to create a processed image. The image is referred to as the image of discharge within the nip. Such images of discharge within the nip were created in the initial period and after the durability test. These images were compared, and results were evaluated based on the following criteria. The results of evaluation are shown in Table 12.

Rank 1; discharge intensity within the nip does not change in the initial period and after the durability test.

Rank 2; discharge intensity within the nip slightly changed after the durability test, compared to that in the initial period.

Rank 3; discharge intensity within the nip significantly reduced after the durability test, compared to that in the initial period.

Rank 4; no discharge within the nip generates after the durability test.

Examples 2 to 110

In the electrophotographic process cartridges having combinations of the charging rollers and the electrophotographic photosensitive members shown in Table 12, the banding image and discharge intensity within the nip were evaluated. The results of evaluation are shown in Table 12.

TABLE 12

| Example | Charging roller | Electrophotographic photosensitive member | Evaluation A | Evaluation B |
|---|---|---|---|---|
| 1 | D18 | A1 | 1 | 1 |
| 2 | D19 | A2 | 1 | 1 |
| 3 | D20 | A3 | 1 | 1 |
| 4 | D1 | A4 | 2 | 1 |
| 5 | D2 | A5 | 2 | 1 |
| 6 | D3 | A6 | 2 | 1 |
| 7 | D4 | A7 | 2 | 1 |
| 8 | D5 | A8 | 2 | 1 |
| 9 | D6 | A9 | 2 | 1 |
| 10 | D7 | A10 | 2 | 1 |
| 11 | D8 | A11 | 2 | 1 |
| 12 | D9 | A1 | 2 | 2 |
| 13 | D10 | A2 | 2 | 1 |
| 14 | D11 | A3 | 2 | 1 |
| 15 | D12 | A4 | 2 | 1 |
| 16 | D13 | A5 | 2 | 1 |
| 17 | D14 | A6 | 2 | 2 |
| 18 | D18 | A7 | 1 | 1 |
| 19 | D19 | A8 | 1 | 1 |
| 20 | D20 | A9 | 1 | 1 |
| 21 | D1 | A10 | 2 | 1 |
| 22 | D2 | A11 | 2 | 1 |

TABLE 12-continued

| Example | Charging roller | Electrophotographic photosensitive member | Evaluation A | Evaluation B |
|---|---|---|---|---|
| 23 | D3 | A1 | 2 | 1 |
| 24 | D4 | A2 | 2 | 1 |
| 25 | D5 | A3 | 2 | 1 |
| 26 | D6 | A4 | 2 | 1 |
| 27 | D7 | A5 | 2 | 1 |
| 28 | D8 | A6 | 2 | 1 |
| 29 | D9 | A7 | 2 | 2 |
| 30 | D10 | A8 | 2 | 1 |
| 31 | D11 | A9 | 2 | 1 |
| 32 | D12 | A10 | 2 | 1 |
| 33 | D13 | A11 | 2 | 1 |
| 34 | D14 | A1 | 2 | 2 |
| 35 | D18 | A2 | 1 | 1 |
| 36 | D19 | A3 | 1 | 1 |
| 37 | D20 | A4 | 1 | 1 |
| 38 | D1 | A5 | 2 | 1 |
| 39 | D2 | A6 | 2 | 1 |
| 40 | D3 | A7 | 2 | 1 |
| 41 | D4 | A8 | 2 | 1 |
| 42 | D5 | A9 | 2 | 1 |
| 43 | D6 | A10 | 2 | 1 |
| 44 | D7 | A11 | 2 | 1 |
| 45 | D8 | A1 | 2 | 1 |
| 46 | D9 | A2 | 2 | 2 |
| 47 | D10 | A3 | 2 | 1 |
| 48 | D11 | A4 | 2 | 1 |
| 49 | D12 | A5 | 2 | 1 |
| 50 | D13 | A6 | 2 | 1 |
| 51 | D14 | A7 | 2 | 2 |
| 52 | D18 | A8 | 1 | 1 |
| 53 | D19 | A9 | 1 | 1 |
| 54 | D20 | A10 | 1 | 1 |
| 55 | D1 | A11 | 2 | 1 |
| 56 | D2 | A1 | 2 | 1 |
| 57 | D3 | A2 | 2 | 1 |
| 58 | D4 | A3 | 2 | 1 |
| 59 | D5 | A4 | 2 | 1 |
| 60 | D6 | A5 | 2 | 1 |
| 61 | D7 | A6 | 2 | 1 |
| 62 | D8 | A7 | 2 | 1 |
| 63 | D9 | A8 | 2 | 2 |
| 64 | D10 | A9 | 2 | 1 |
| 65 | D11 | A10 | 2 | 1 |
| 66 | D12 | A11 | 2 | 1 |
| 67 | D13 | A1 | 2 | 1 |
| 68 | D14 | A2 | 2 | 2 |
| 69 | D18 | A3 | 1 | 1 |
| 70 | D19 | A4 | 1 | 1 |
| 71 | D20 | A5 | 1 | 1 |
| 72 | D1 | A6 | 2 | 1 |
| 73 | D2 | A7 | 2 | 1 |
| 74 | D3 | A8 | 2 | 1 |
| 75 | D4 | A9 | 2 | 1 |
| 76 | D5 | A10 | 2 | 1 |
| 77 | D6 | A11 | 2 | 1 |
| 78 | D7 | A1 | 2 | 1 |
| 79 | D8 | A2 | 2 | 1 |
| 80 | D9 | A3 | 2 | 2 |
| 81 | D10 | A4 | 2 | 1 |
| 82 | D11 | A5 | 2 | 1 |
| 83 | D12 | A6 | 2 | 1 |
| 84 | D13 | A7 | 2 | 1 |
| 85 | D14 | A8 | 2 | 2 |
| 86 | D18 | A9 | 1 | 1 |
| 87 | D19 | A10 | 1 | 1 |
| 88 | D20 | A11 | 1 | 1 |
| 89 | D1 | A1 | 2 | 1 |
| 90 | D2 | A2 | 2 | 1 |
| 91 | D3 | A3 | 2 | 1 |
| 92 | D4 | A4 | 2 | 1 |
| 93 | D5 | A5 | 2 | 1 |
| 94 | D6 | A6 | 2 | 1 |
| 95 | D7 | A7 | 2 | 1 |
| 96 | D8 | A8 | 2 | 1 |
| 97 | D9 | A9 | 2 | 2 |
| 98 | D10 | A10 | 2 | 1 |

TABLE 12-continued

| Example | Charging roller | Electrophotographic photosensitive member | Evaluation A | Evaluation B |
|---|---|---|---|---|
| 99 | D11 | A11 | 2 | 1 |
| 100 | D12 | A1 | 2 | 1 |
| 101 | D13 | A2 | 2 | 1 |
| 102 | D14 | A3 | 2 | 2 |
| 103 | D18 | A4 | 1 | 1 |
| 104 | D19 | A5 | 1 | 1 |
| 105 | D20 | A6 | 1 | 1 |
| 106 | D1 | A7 | 2 | 1 |
| 107 | D2 | A8 | 2 | 1 |
| 108 | D3 | A9 | 2 | 1 |
| 109 | D4 | A10 | 2 | 1 |
| 110 | D5 | A11 | 2 | 1 |

Comparative Example 1

In the electrophotographic process cartridge, the banding image and discharge intensity within the nip were evaluated by the same methods as those in Example 1 except that the electrophotographic photosensitive member A1 was replaced by the electrophotographic photosensitive member A12. The results of evaluation are shown in Table 13.

Comparative Examples 2 to 64

In the electrophotographic process cartridges having combinations of the charging rollers and the electrophotographic photosensitive members shown in Table 13, the banding image and discharge intensity within the nip were evaluated. The results of evaluation are shown in Table 13.

TABLE 13

| Comparative Example | Charging roller | Electrophotographic photosensitive member | Evaluation A | Evaluation B |
|---|---|---|---|---|
| 1 | D18 | A12 | 3 | 1 |
| 2 | D19 | A12 | 3 | 1 |
| 3 | D20 | A12 | 3 | 1 |
| 4 | D1 | A12 | 3 | 1 |
| 5 | D2 | A12 | 3 | 1 |
| 6 | D3 | A12 | 3 | 1 |
| 7 | D4 | A12 | 3 | 1 |
| 8 | D5 | A12 | 3 | 1 |
| 9 | D6 | A12 | 3 | 1 |
| 10 | D7 | A12 | 3 | 1 |
| 11 | D8 | A12 | 3 | 1 |
| 12 | D9 | A12 | 3 | 2 |
| 13 | D10 | A12 | 3 | 1 |
| 14 | D11 | A12 | 3 | 1 |
| 15 | D12 | A12 | 3 | 1 |
| 16 | D13 | A12 | 3 | 1 |
| 17 | D14 | A12 | 3 | 2 |
| 18 | D15 | A12 | 3 | 4 |
| 19 | D16 | A12 | 3 | 3 |
| 20 | D17 | A12 | 3 | 1 |
| 21 | D15 | A1 | 3 | 4 |
| 22 | D16 | A2 | 3 | 3 |
| 23 | D17 | A3 | 3 | 1 |
| 24 | D15 | A4 | 3 | 4 |
| 25 | D16 | A5 | 3 | 3 |
| 26 | D17 | A6 | 3 | 1 |
| 27 | D15 | A7 | 3 | 4 |
| 28 | D16 | A8 | 3 | 3 |
| 29 | D17 | A9 | 3 | 1 |
| 30 | D15 | A10 | 3 | 4 |
| 31 | D16 | A11 | 3 | 3 |
| 32 | D17 | A1 | 3 | 1 |
| 33 | D15 | A2 | 3 | 4 |

TABLE 13-continued

| Comparative Example | Charging roller | Electrophotographic photosensitive member | Evaluation A | Evaluation B |
|---|---|---|---|---|
| 34 | D16 | A3 | 3 | 3 |
| 35 | D17 | A4 | 3 | 1 |
| 36 | D15 | A5 | 3 | 4 |
| 37 | D16 | A6 | 3 | 3 |
| 38 | D17 | A7 | 3 | 1 |
| 39 | D15 | A8 | 3 | 4 |
| 40 | D16 | A9 | 3 | 3 |
| 41 | D17 | A10 | 3 | 1 |
| 42 | D15 | A11 | 3 | 4 |
| 43 | D16 | A1 | 3 | 3 |
| 44 | D17 | A2 | 3 | 1 |
| 45 | D15 | A3 | 3 | 4 |
| 46 | D16 | A4 | 3 | 3 |
| 47 | D17 | A5 | 3 | 1 |
| 48 | D15 | A6 | 3 | 4 |
| 49 | D16 | A7 | 3 | 3 |
| 50 | D17 | A8 | 3 | 1 |
| 51 | D15 | A9 | 3 | 4 |
| 52 | D16 | A10 | 3 | 3 |
| 53 | D17 | A11 | 3 | 1 |
| 54 | D15 | A1 | 3 | 4 |
| 55 | D16 | A2 | 3 | 3 |
| 56 | D17 | A3 | 3 | 1 |
| 57 | D15 | A4 | 3 | 4 |
| 58 | D16 | A5 | 3 | 3 |
| 59 | D17 | A6 | 3 | 1 |
| 60 | D15 | A7 | 3 | 4 |
| 61 | D16 | A8 | 3 | 3 |
| 62 | D17 | A9 | 3 | 1 |
| 63 | D15 | A10 | 3 | 4 |
| 64 | D16 | A11 | 3 | 3 |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-014877, filed Jan. 29, 2013 which is hereby incorporated by reference herein in its entirety.

What is claimed is:

1. An electrophotographic process cartridge comprising a charging member; and an electrophotographic photosensitive member which is electrically charged upon being brought into contact with the charging member, wherein:

the charging member comprises an electro-conductive substrate, and a surface layer formed on the electro-conductive substrate;

the surface layer contains at least a binder resin, an electron conductive agent, and a resin particle having a plurality of pores inside thereof;

the surface of the surface layer has a protrusion derived from the resin particle; wherein:

the electrophotographic photosensitive member comprises a support; and a photosensitive layer formed on the support; and a surface layer of the electrophotographic photosensitive member contains the following resin (1), resin (2), and compound (3):

resin (1): at least one resin selected from the group consisting of polycarbonate resins having no siloxane structure at a terminal and polyester resins having no siloxane structure at a terminal;

resin (2): at least one resin selected from the group consisting of polycarbonate resins having a siloxane structure at a terminal, polyester resins having a siloxane structure at a terminal, and acrylic resins having a siloxane structure at a terminal;

compound (3): at least one compound selected from the group consisting of methyl benzoate, ethyl benzoate, benzyl acetate, ethyl 3-ethoxypropionate, and diethylene glycol ethyl methyl ether; and wherein:

the resin particle has a porosity of 5% by volume or more in a region in the resin particle, the region being farthest away from the electro-conductive substrate, and assuming that the resin particle is solid particle, the region corresponding to 11% by volume of the solid particle.

2. The process cartridge according to claim 1, wherein the polycarbonate resin having no siloxane structure at a terminal is a polycarbonate resin A having a structural unit represented by the following formula (A):

(A)

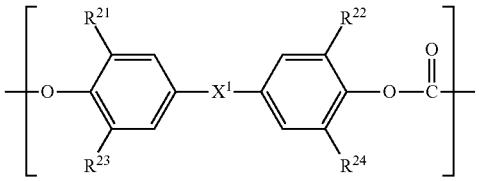

wherein $R^{21}$ to $R^{24}$ each independently represent a hydrogen atom or a methyl group; $X^1$ represents a single bond, a cyclohexylidene group, or a divalent group having a structure represented by the following formula (C):

(C)

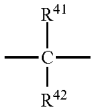

wherein $R^{41}$ and $R^{42}$ each independently represent a hydrogen atom, a methyl group, or a phenyl group.

3. The process cartridge according to claim 2, wherein the polycarbonate resin A is a polymer having only one kind of structural unit or a combination of two or more kinds of structural units selected from structural units represented by the following formulas (A-1) to (A-8):

(A-1)

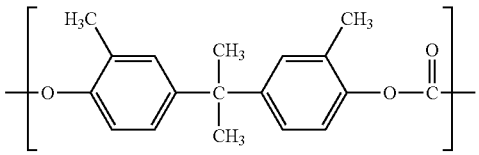

(A-2)

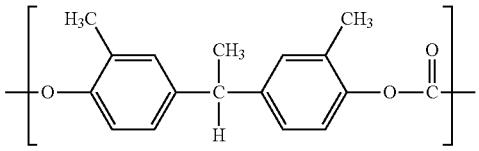

-continued (A-3)

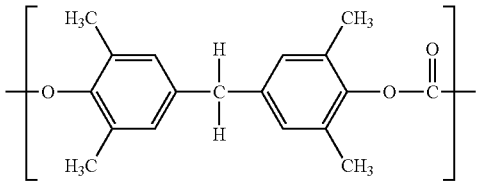

(A-4)

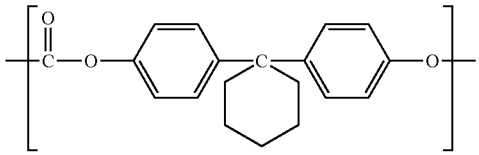

(A-5)

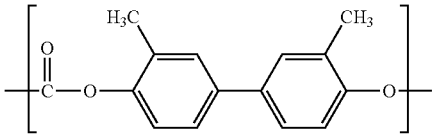

(A-6)

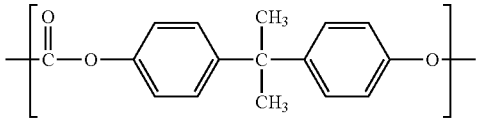

(A-7)

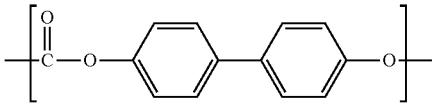

(A-8)

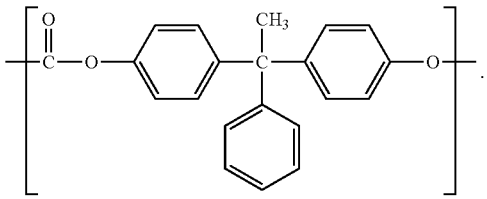

4. The process cartridge according to claim 1, wherein the polyester resin having no siloxane structure at a terminal is a polyester resin B having a structural unit represented by the following formula (B):

(B)

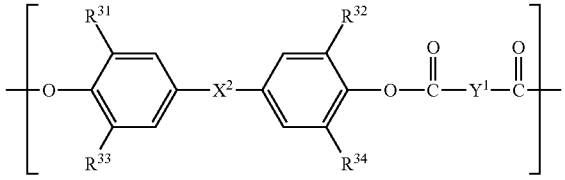

wherein $R^{31}$ to $R^{34}$ each independently represent a hydrogen atom or a methyl group; $X^2$ represents a single bond, a cyclohexylidene group, or a divalent group having a structure represented by the following formula (C); and $Y^1$ represents a m-phenylene group, a p-phenylene group, or a divalent group in which two p-phenylene groups are bonded via an oxygen atom, (C)

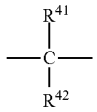

wherein $R^{41}$ and $R^{42}$ each independently represent a hydrogen atom, a methyl group, or a phenyl group.

5. The process cartridge according to claim 4, wherein the polyester resin B is a polymer having only one kind of structural unit or a combination of two or more kinds of structural units selected from structural units represented by the following formulas (B-1) to (B-9):

6. The process cartridge according to claim 1, wherein the polycarbonate resin having a siloxane structure at a terminal is a polycarbonate resin A' having a structural unit represented by the following formula (A') and a terminal structure represented by the following formula (D):

(A')

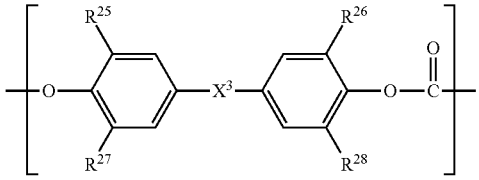

(B-1)

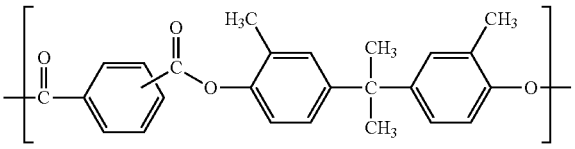

(B-2)

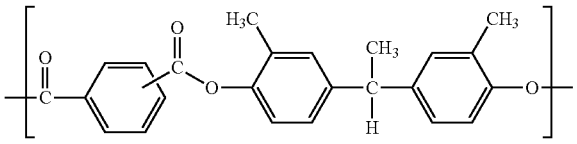

(B-3)

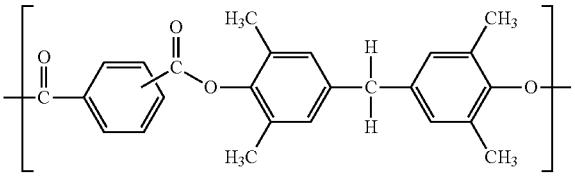

(B-4)

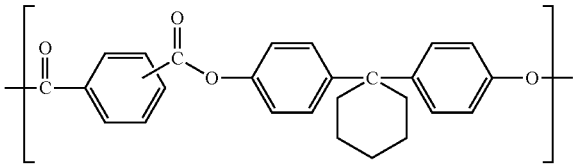

(B-5)

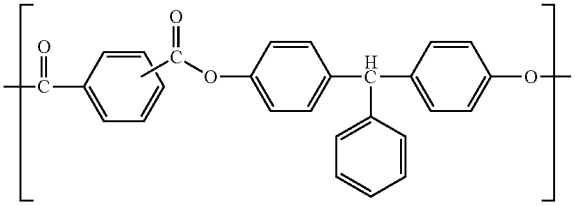

(B-6)

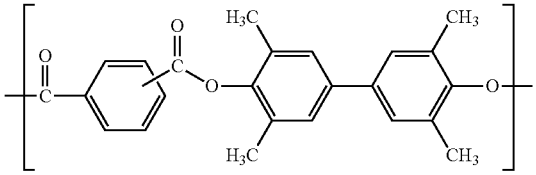

(B-7)

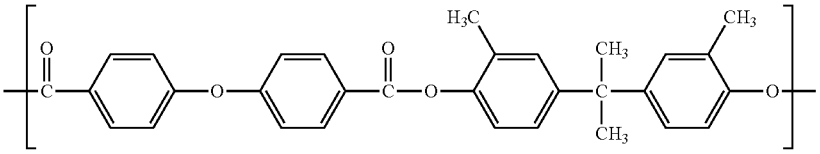

(B-8)

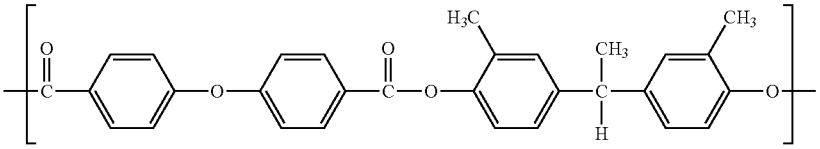

(B-9)

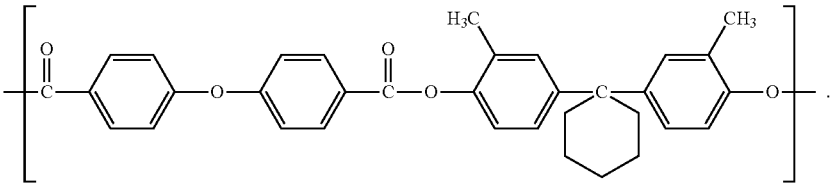

wherein $R^{25}$ to $R^{28}$ each independently represent a hydrogen atom or a methyl group; $X^3$ represents a single bond, a cyclohexylidene group, or a divalent group having a structure represented by the following formula (C'):

(C')

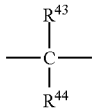

wherein $R^{43}$ and $R^{44}$ each independently represent a hydrogen atom, a methyl group, or a phenyl group, (D)

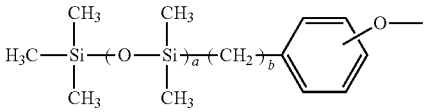

wherein a and b represent a repetition number of the structural unit within the brackets, an average value of a is 20 or more and 100 or less, and an average value of b is 1 or more and 10 or less.

7. The process cartridge according to claim 1, wherein the polyester resin having a siloxane structure at a terminal is a polyester resin B' having a structural unit represented by the following formula (B') and a terminal structure represented by the following formula (D):

(B')

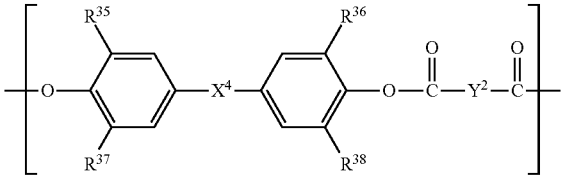

wherein $R^{35}$ to $R^{38}$ each independently represent a hydrogen atom or a methyl group; $X^4$ represents a single bond, a cyclohexylidene group, or a divalent group having a structure represented by the following formula (C'); $Y^2$ represents a m-phenylene group, a p-phenylene group, or a divalent group in which two p-phenylene groups are bonded via an oxygen atom, (C')

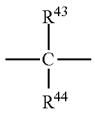

wherein $R^{43}$ and $R^{44}$ each independently represent a hydrogen atom, a methyl group, or a phenyl group, (D)

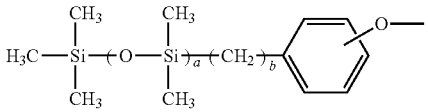

wherein a and b represent a repetition number of the structural unit within the brackets, an average value of a is 20 or more and 100 or less, and an average value of b is 1 or more and 10 or less.

8. An electrophotographic apparatus on which the electrophotographic process cartridge according to claim 1 is mounted.

* * * * *